US006079661A

United States Patent [19]

Klimek et al.

[11] Patent Number: 6,079,661

[45] Date of Patent: Jun. 27, 2000

[54] AUTOMATIC SPLICER FOR UNWINDER

[75] Inventors: Wayne D. Klimek, Green Bay; Daniel J. Moran, Little Chute, both of Wis.

[73] Assignee: Paper Converting Machine Co., Green Bay, Wis.

[21] Appl. No.: 09/216,323

[22] Filed: Dec. 18, 1998

[51] Int. Cl.[7] ..... B65H 19/00; B65H 19/18

[52] U.S. Cl. ..... 242/551; 242/556; 242/559

[58] Field of Search ..... 242/551, 556, 242/559, 554, 560; 156/502

[56] References Cited

U.S. PATENT DOCUMENTS

| | | | |
|---|---|---|---|
| Re. 28,353 | 3/1975 | Nystrand . | |
| 3,740,296 | 6/1973 | McDonald . | |
| 3,753,833 | 8/1973 | Bassett . | |
| 3,858,819 | 1/1975 | Butler . | |
| 4,392,912 | 7/1983 | Horsley . | |
| 4,629,531 | 12/1986 | Kataoka . | |
| 4,708,300 | 11/1987 | Goetz . | |
| 4,723,724 | 2/1988 | Bradley . | |
| 4,908,091 | 3/1990 | Traegaardh . | |
| 5,104,055 | 4/1992 | Buxton . | |
| 5,330,126 | 7/1994 | Grischenko | 242/559 |
| 5,584,446 | 12/1996 | Delmore . | |
| 5,730,389 | 3/1998 | Biagiotti | 242/556.1 |

FOREIGN PATENT DOCUMENTS

| | | |
|---|---|---|
| 0 694 020B1 | 7/1997 | European Pat. Off. . |
| 1213819 | 1/1987 | Italy . |
| WO 91/16256 | 10/1991 | WIPO . |

*Primary Examiner*—John Q. Nguyen

[57] ABSTRACT

A splicing apparatus for an unwinder automatically splices the trailing end of a web from one roll to the leading end of a web from a second roll. A pair of roll support frames are mounted for movement between an unwinding position in which a roll on the support frame is aligned with the path of web movement and a loading position in which a roll on the support frame is laterally offset from the path of web movement. A vacuum retainer is mounted on each of the roll support frames for retaining a leading edge of the web of a new roll. A movable vacuum belt is mounted adjacent the path of web movement, and a slitter is mounted upstream of the vacuum belt. When a first roll in the unwinding position is to be replaced, the first web is secured by the vacuum belt and cut by the slitter to form a trailing end. The roll support frames are moved to bring a second roll into the unwinding position. The leading end portion of the second web is adjacent the trailing end portion of the first web. A ply bonder presses the two webs against the vacuum retainer to bond the webs as the vacuum belt advances the trailing end of the first web.

7 Claims, 22 Drawing Sheets

AUTOMATIC SPLICER FOR UNWINDER

BACKGROUND OF THE INVENTION

This invention relates to an unwinder for a roll of web material, and, more particularly, to an automatic splicer for splicing the web of a first roll to the web of a second roll.

Unwinders are commonly used to unwind a roll of wound web material so that the web can be processed by equipment downstream of the unwinder. For example, in the paper converting field a large parent roll of paper is unwound and advanced to a rewinder, which perforates the paper to form individual sheets and rewinds the paper into consumer-sized logs or rolls of bathroom tissue or paper towels. Examples of such rewinders are described in U.S. Pat. Nos. Re. 28,353, 4,723,724, 5,104,055 and EPO Patent No. 0 694 020 B1.

When a parent roll is completely unwound or almost completely unwound, or when it is desired to change the parent roll for any other reason, the parent roll must be removed from the unwinder and replaced with a new roll. The leading end of the new roll must be joined or spliced to the trailing end of the old roll so that a continuous web is advanced through the downstream equipment.

Co-owned U.S. patent application entitled "Center Drive Unwind System," Ser. No. 08/838,278, filed Apr. 16, 1997, now U.S. Pat. No. 5,906,333, describes a center drive unwinder which automatically replaces parent rolls and splices the trailing end of the old roll and the leading end of the new roll.

Many unwinders are not center driven. Instead, the roll is rotatably mounted on the unwinder, and a belt driven mechanism engages the surfaces of the roll to rotate the roll and to unwind the web.

U.S. Pat. No. 5,730,389 describes a device for changing and splicing rolls on a belt-driven unwinder. Two rolls are mounted on movable carriages. The first roll is unwound by the belt, and the second roll is laterally offset from the first roll. The leading end of the second roll is retained by a suction member on the carriage. When the rolls are to be changed, a second suction member and a blade are moved against the web to cut the web and hold the trailing end of the web against the second suction member. The second suction member and the blade are then moved away from the web path. The carriages are moved to bring the second roll into the unwinding position, and the leading end of the second roll is joined to the trailing end of the first roll.

SUMMARY OF THE INVENTION

The invention provides an improved device for automatically changing and splicing rolls for an unwinder. First and second rolls are mounted on a movable carriage. The first roll is in an unwinding position, and the second roll is laterally offset from the first roll. Prior to moving the carriage, a slitter traverses across the web to provide a fast and even cut of the web. The carriage is then moved to bring the second roll into the unwinding position. The leading end of the second web is held by a web retainer on the carriage. The trailing end of the first web and the leading end of the second web are spliced together, for example, by a bonding roller o by adhesive tape. A second bonding roller presses both webs against the combination vacuum and bonding roller to bond the two webs as the vacuum belt advances the first web toward the bonding rollers.

DESCRIPTION OF THE DRAWING

The invention will be explained in conjunction with illustrative embodiments shown in the accompanying drawing, in which.

DESCRIPTION OF SPECIFIC EMBODIMENTS

A. FIGS. 1–14

Figure 1:
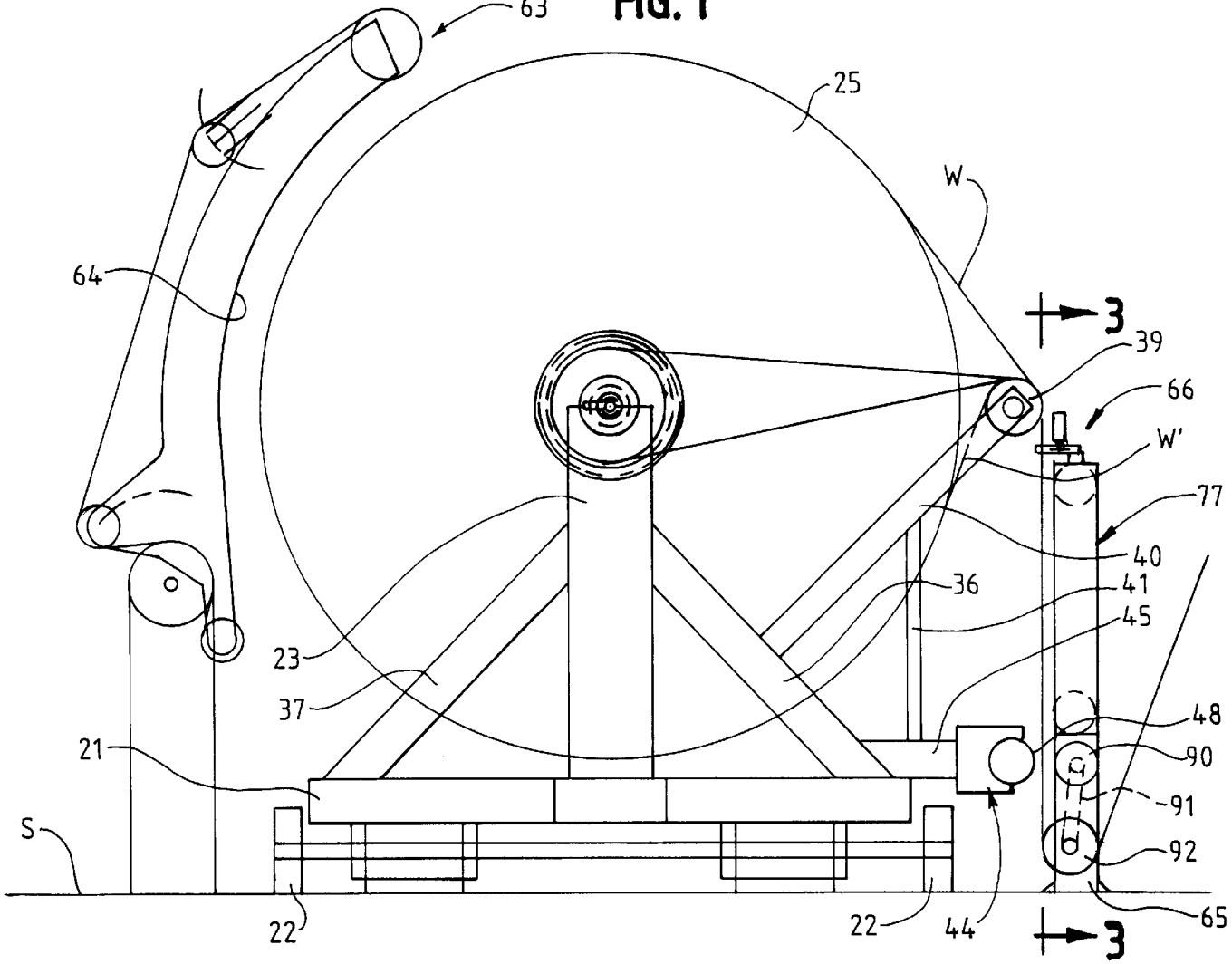
FIG. 1 is a side elevational view of one embodiment of an unwinding and splicing apparatus which is formed in accordance with the invention.
Figure 2:
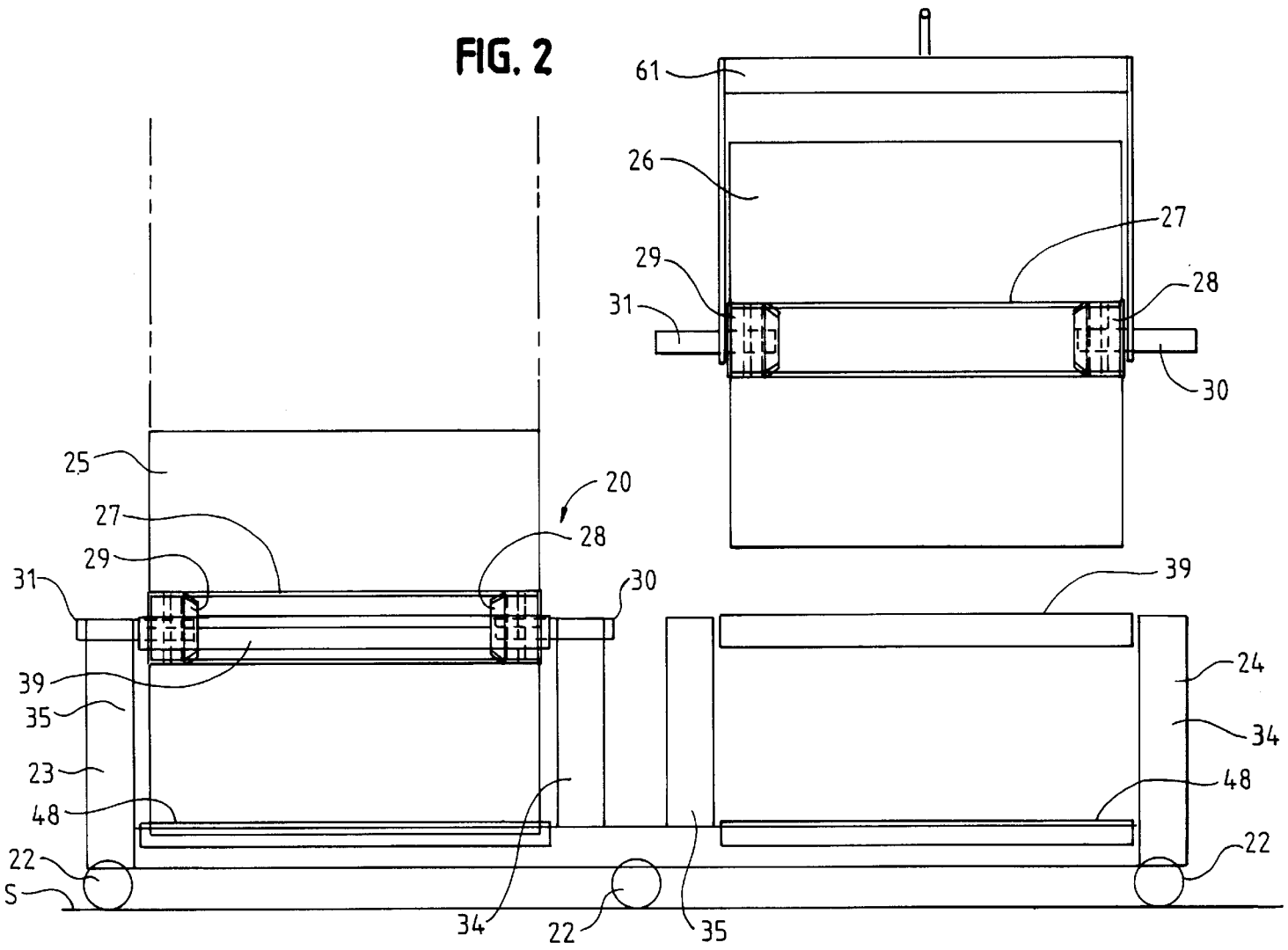
FIG. 2 is a front elevational view of the carriage of the unwinding and splicing apparatus.

Referring to FIGS. 1 and 2, an unwinding and splicing apparatus 20 includes a carriage 21 which is mounted on rollers 22 for movement on a support surface S. The carriage includes two support frames 23 and 24 for rotatably supporting first and second parent rolls 25 and 26. Each parent roll includes a hollow center core 27, and right and left chucks 28 and 29 are inserted into the open ends of the core. Right and left journals 30 and 31 extend axially from the chucks.

Each of the roll support frames 23 and 24 includes right and left vertical posts 34 and 35 for rotatably supporting the journals 30 and 31 and front and rear angled braces 36 and 37 for reinforcing the vertical posts. An idler roll 39 is rotatably supported on each roll support frame by angled arms 40 which extend from the front braces 36 and by vertical braces 41.

Figure 8:
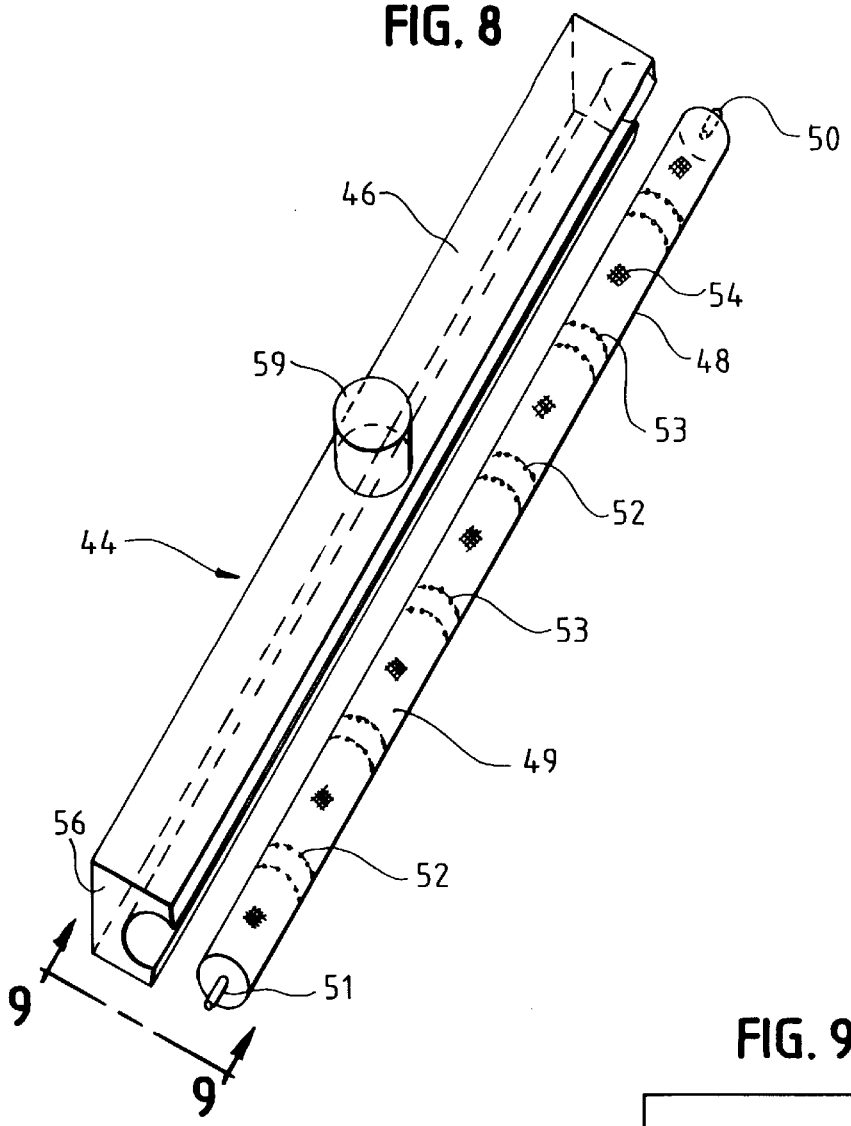
FIG. 8 is an exploded perspective view of the vacuum bonding roller assembly.
Figure 9:
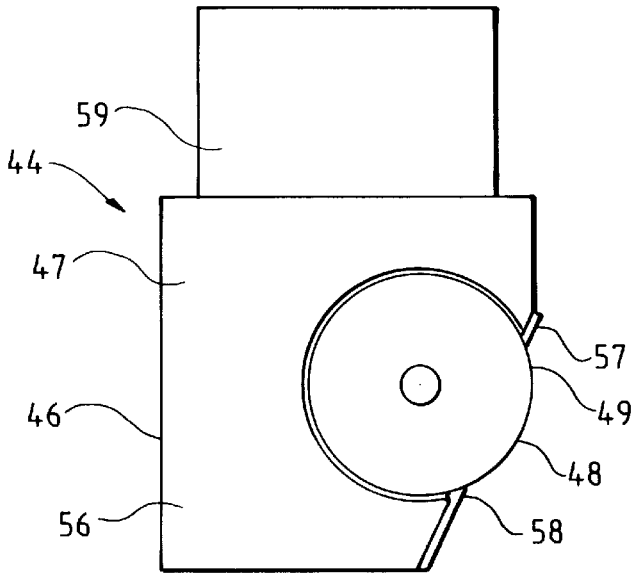
FIG. 9 is a sectional view of the vacuum bonding roller assembly taken along the line 9—9 of FIG. 8.

A vacuum bonding roll assembly 44 (FIG. 1) is supported on each of the roll support frames by support arms 45. Referring to FIGS. 8 and 9, each of the vacuum bonding roll assemblies includes a casing 46 which encloses a vacuum plenum 47 and a steel vacuum and bonding roll 48 which is rotatably mounted in the casing.

The roll 48 is hollow and includes a cylindrical wall 49 and journals 50 and 51. A plurality of vacuum ports or openings 52 are drilled through the cylindrical wall. In the embodiment illustrated the vacuum ports are arranged in a series of axially spaced pairs 53 of circumferentially extending rows. The surface of the roll between each pairs of rows is knurled or roughened to provide a conventional ply bonding surface, only a portion of which is illustrated at 54. Alternatively, the ply bonding surface can be provided over the entire surface of the roll, including the area between the pairs of rows 53.

The roll 48 is rotatably mounted in end walls 56 of the casing 46. Top and bottom seals 57 and 58 engage the roll. A source of vacuum is connected to the plenum 47 through tube 59. The vacuum ports 52 on the roll 48 which are inside of the seals 57 and 58 are exposed to the vacuum in the plenum, and vacuum or suction is thereby applied to the vacuum ports which are on the exposed surface of the roll.

In FIG. 2 the left hand roll support frame 23 is aligned with the path in which the web is unwound and advanced to equipment downstream of the unwinder, for example, a rewinder. The parent roll 25 is in the unwinding position. The right hand roll support frame 24 is laterally offset from the path of web movement and is in the loading position. The new parent roll 26 is being loaded by a crane 61 onto the roll support frame 24. Other loading devices can be used to move the new parent roll into position.

The parent roll in the unwinding position is rotated by a conventional belt drive assembly 63 (FIG. 1). A belt 64 engages the outside surface of the roll and rotates the roll in the desired direction. The roll can be rotated either clockwise so that the web unwinds from the top of the roll as indicated by the solid line W or counterclockwise so that the web unwinds from the bottom of the roll as indicated by the dashed line W. In either case the web is fed over the idler roll 39 which is mounted in front of the parent roll.

As will be explained more fully hereinafter, when the parent roll 25 expires or is to be changed for any other reason, the belt drive assembly 63 is disengaged from the parent roll, and the carriage 21 is moved to the left in FIG. 2 to bring the new roll 26 into the unwinding position. The roll support frame 23 is then in an unloading position, and a new parent roll can be loaded onto the frame 23 while the parent roll 26 unwinds.

The unwinding and splicing apparatus also includes a slitter assembly 66 which is mounted just below the idler roll 39 of the roll support frame which is in the unwinding position. The slitter is mounted in a stationary support frame 65 (FIG. 1) which is supported by the surface S.

Figure 7:
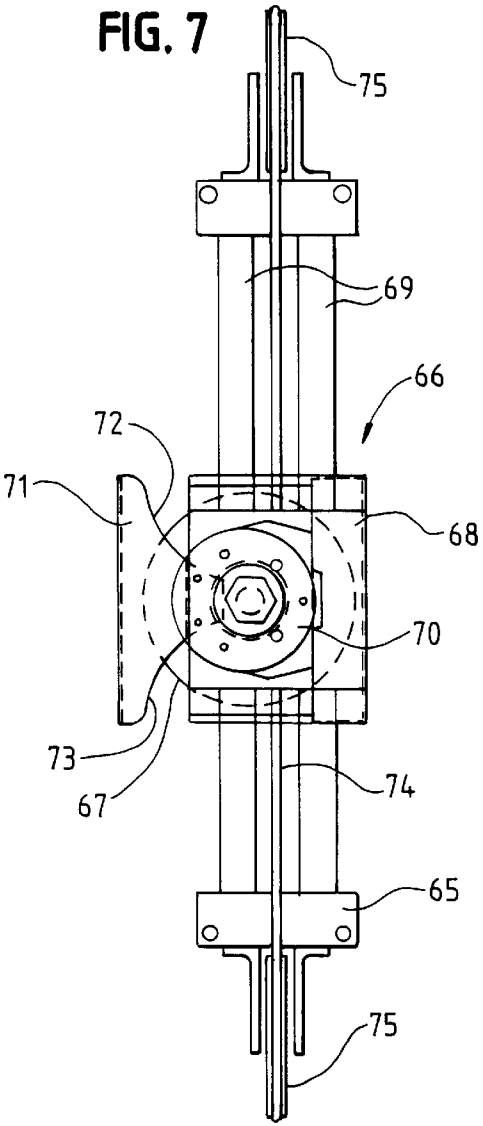
FIG. 7 is a top view of the slitter.
Figure 6:
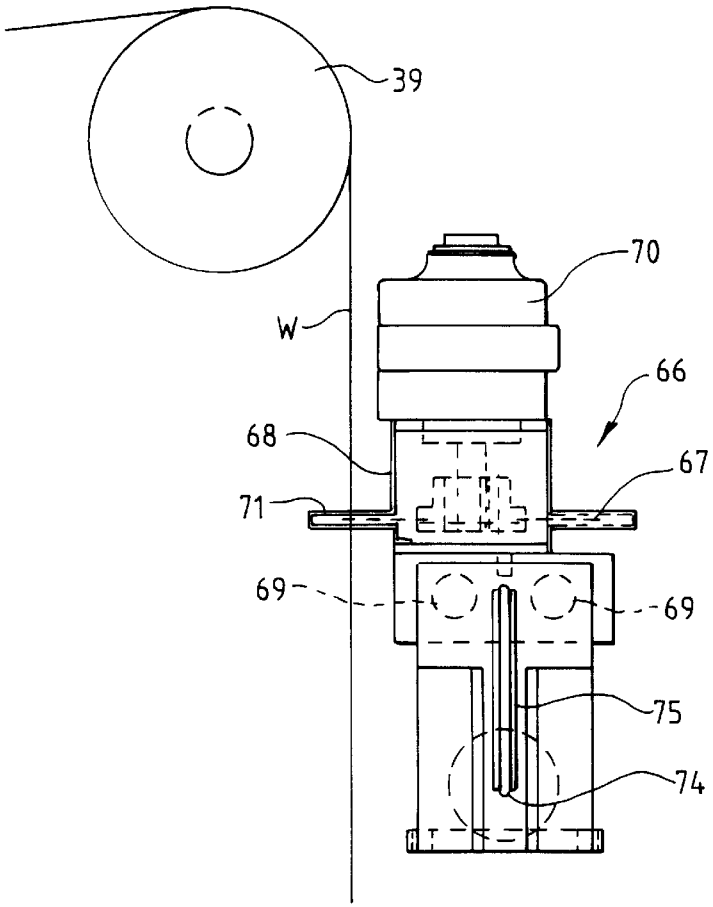
FIG. 6 is an enlarged side view of the slitter.

Referring to FIGS. 6 and 7, the slitter assembly includes a disc blade 67 which is rotatably mounted in a carriage 68 which rides on a pair of rails 69. The blade is rotated by a motor 70 on the carriage, and the axis of rotation extends parallel to the path of web movement. A guard 71 surrounds most of the blade and is provided with two side slots 72 and 73 which expose portions of the blade.

The rail 69 extends transversely across the path of web movement, and the carriage 68 is traversed on the rails by an endless cable 74 which extends around a pair of pulleys 75 which are rotatably mounted on the stationary support frame 65. One or both of the pulleys can be driven by a drive shaft to move the cable so that the attached carriage traverses across the web at a high rate of speed and the blade cuts the web. Other traversing means can be used to move the carriage across the web. As the carriage traverses across the web, the web is guided by one of the slots 72 or 73 to the blade 67 so that even a slack web can be cut.

Referring to FIG. 2, the carriage 68 moves from the right to the left to cut the web on the parent roll 25. The carriage is then positioned on the left and will not interfere with movement of the second parent roll 26 into the unwinding position. The cable is moved in the opposite direction so that the carriage is moved from the left to the right to cut the web of the second parent roll 26.

Figure 3:
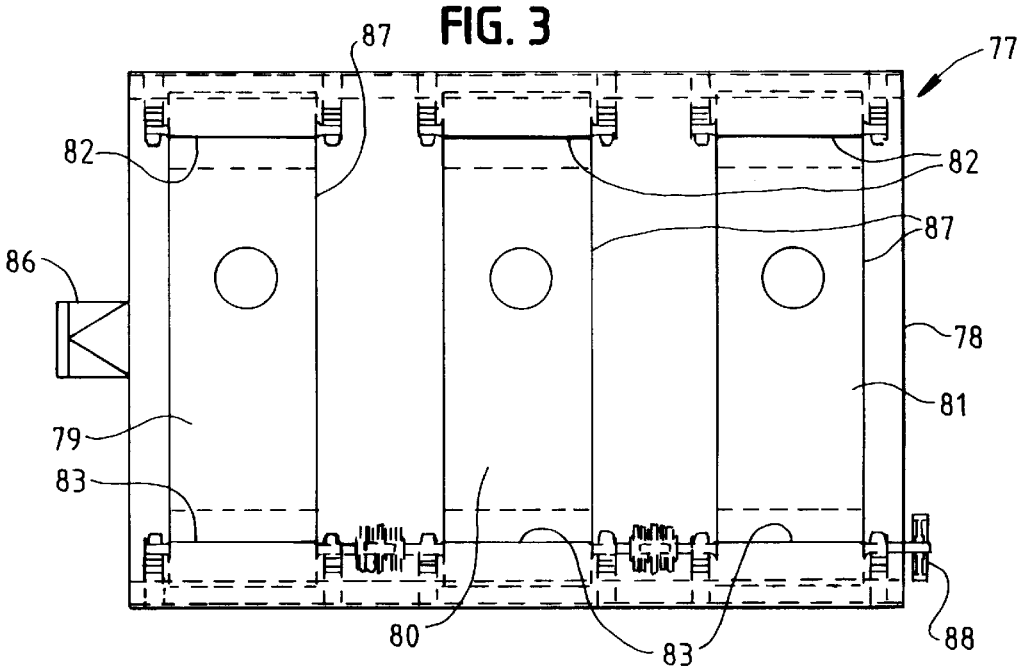
FIG. 3 is an elevational view of the vacuum belt apparatus taken along the line 3—3 of FIG. 1.
Figure 4:
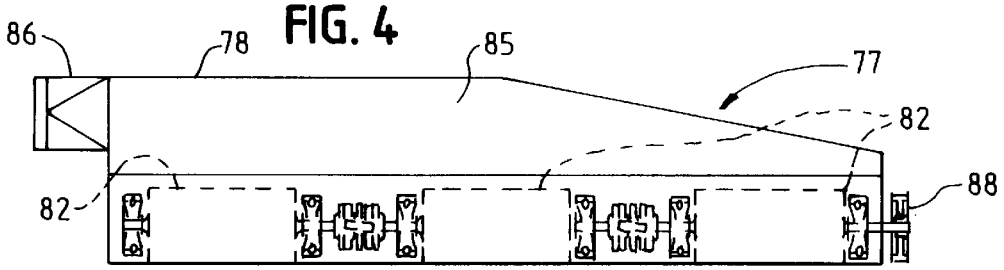
FIG. 4 is a top plan view of the vacuum belt apparatus.
Figure 5:
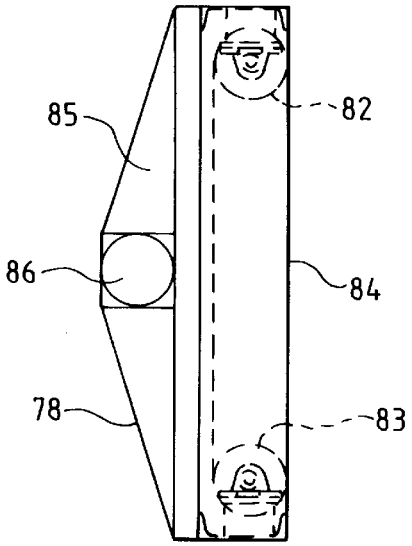
FIG. 5 is a left side view of the vacuum belt apparatus.

Referring to FIG. 1, a vacuum belt assembly 77 is mounted just downstream from the slitter assembly 66 on the stationary frame which supports the slitter assembly. The vacuum belt assembly includes a frame or casing 78 (FIGS. 3–5) and elongated vacuum belts 79–81 which are entrained over upper and lower rollers 82 and 83. One of the rollers is driven, e.g., by pulley 88, so that the outer run 84 (FIG. 5) of each belt can move downwardly parallel to the direction of web movement.

The frame 78 provides a vacuum plenum 85 which is connected to a source of vacuum by a pipe 86. Each of the vacuum belts is mounted in an opening 87 in the frame, and the vacuum belts are porous or perforated so that vacuum or suction can be provided on the exposed surface of each belt. Vacuum belt material is well known in the art.

A conventional ply bonding wheel 90 (FIG. 1) is mounted downstream of the vacuum belt assembly 77 on a pivot arm 91. The pivot arm is advantageously mounted on the axle on an idler roll 92 for the web W. The ply bonding wheel is aligned with the vacuum bonding roll 48 of the roll support frame which is in the unwinding position. The ply bonding wheel is provided with a knurled or roughened surface which cooperates with the roughened surface of the vacuum bonding roll 48 to bond two plies of web together in a well known manner.

Operation

FIG. 1 illustrates the unwinding and splicing apparatus during normal unwinding except that the drive belt 64 is not engaging the parent roll 25. The web W extends from the parent roll over the idler roll 39, past the slitter 66, vacuum belt assembly 77, and the opposed bonding rolls 48 and 90, and over the idler roll 92 to the web-processing equipment which is downstream from the unwinder.

Figure 10:
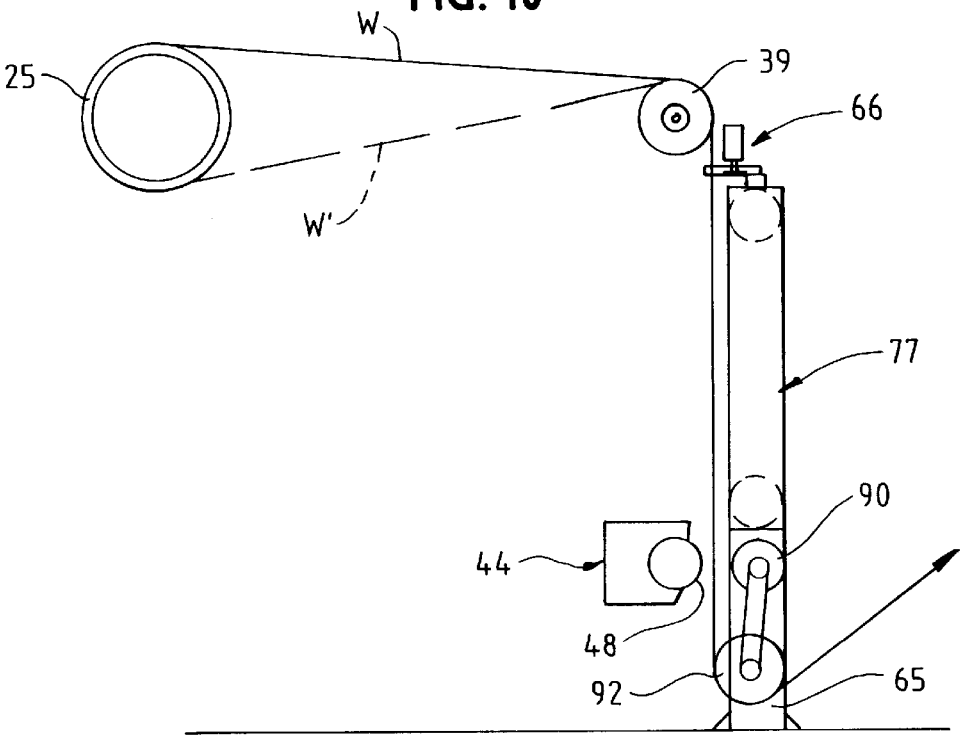
FIG. 10 is a schematic illustration of a parent roll which is about to expire, the supporting structure for the roll being omitted for clarity.

FIG. 10 is a schematic illustration of the apparatus just before parent rolls are changed. The parent roll 25 has been unwound to the extent that the roll is almost expired. The drive belt 64 is stopped to stop further rotation of the parent roll.

Figure 11:
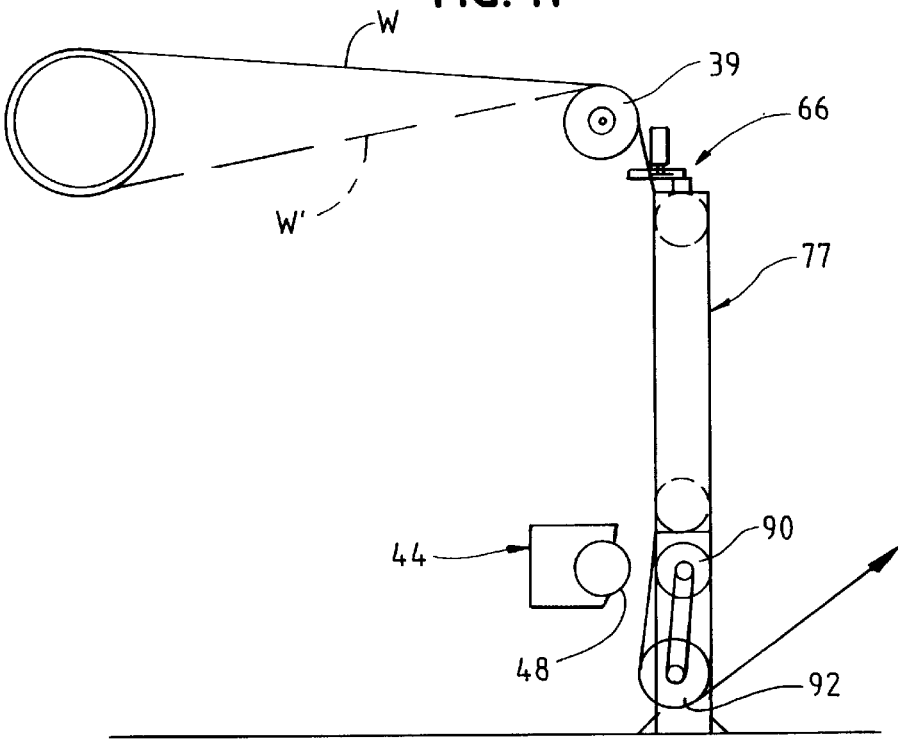
FIG. 11 is a view similar to FIG. 10 showing the web held by the vacuum belt assembly and being cut by the slitter.

FIG. 11 shows the web after vacuum is supplied to the vacuum belt assembly 77. The web is sucked against the vacuum belts, which are slightly offset from the path of web movement during unwinding. After the web is retained by the vacuum belts, the slitter traverses to cut the web.

Figure 12:
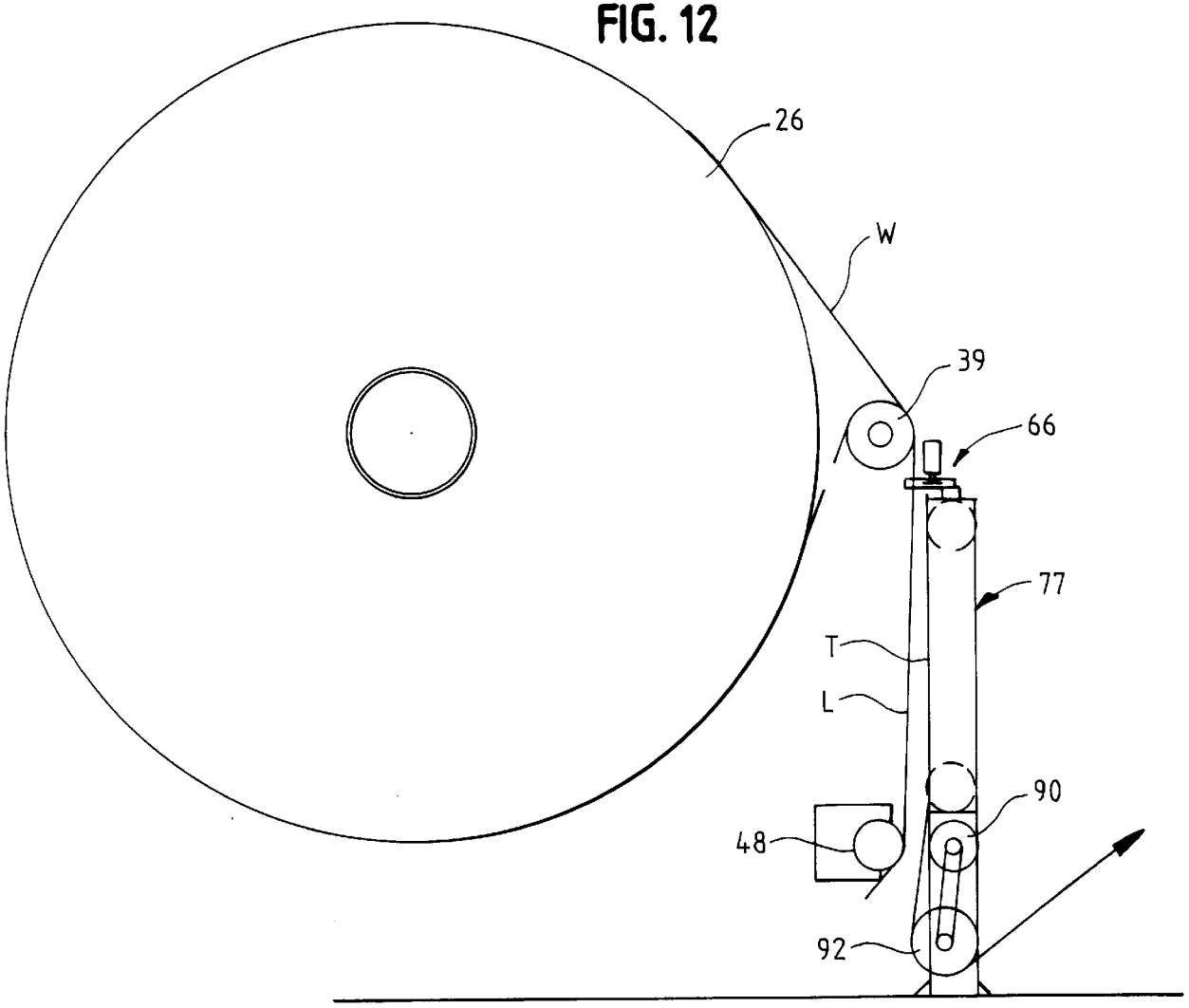
FIG. 12 illustrates a new parent roll moved into alignment with the trailing end of the web from the first parent roll.

FIG. 12 shows the new parent roll 26 moved into the unwinding position. Before the carriage 21 is moved, the leading end L of the new roll is draped over the idler roll 39 of the roll support frame 24 and retained by the vacuum/bonding roll 48 of the roll support frame 24. When the carriage 21 moves the new parent roll 26 into the unwinding position, the leading end L of the new roll 26 is adjacent the severed trailing end T of the web from the old roll 25. The old roll 25 has been moved laterally away from the severed trailing end T.

Figure 13:
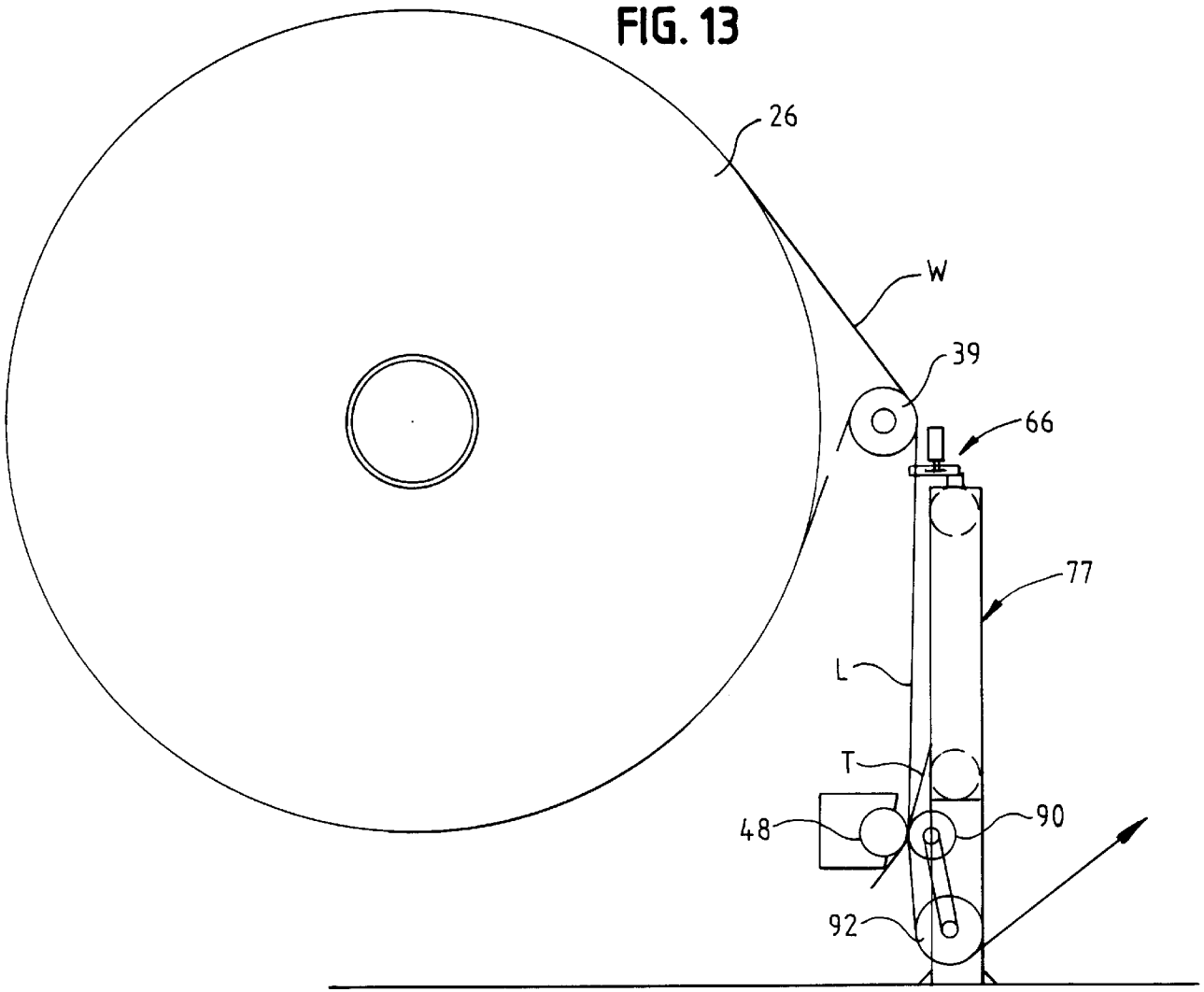
FIG. 13 illustrates the ply bonding device bonding the trailing end of the old web with the leading end of the new web.
Figure 14:
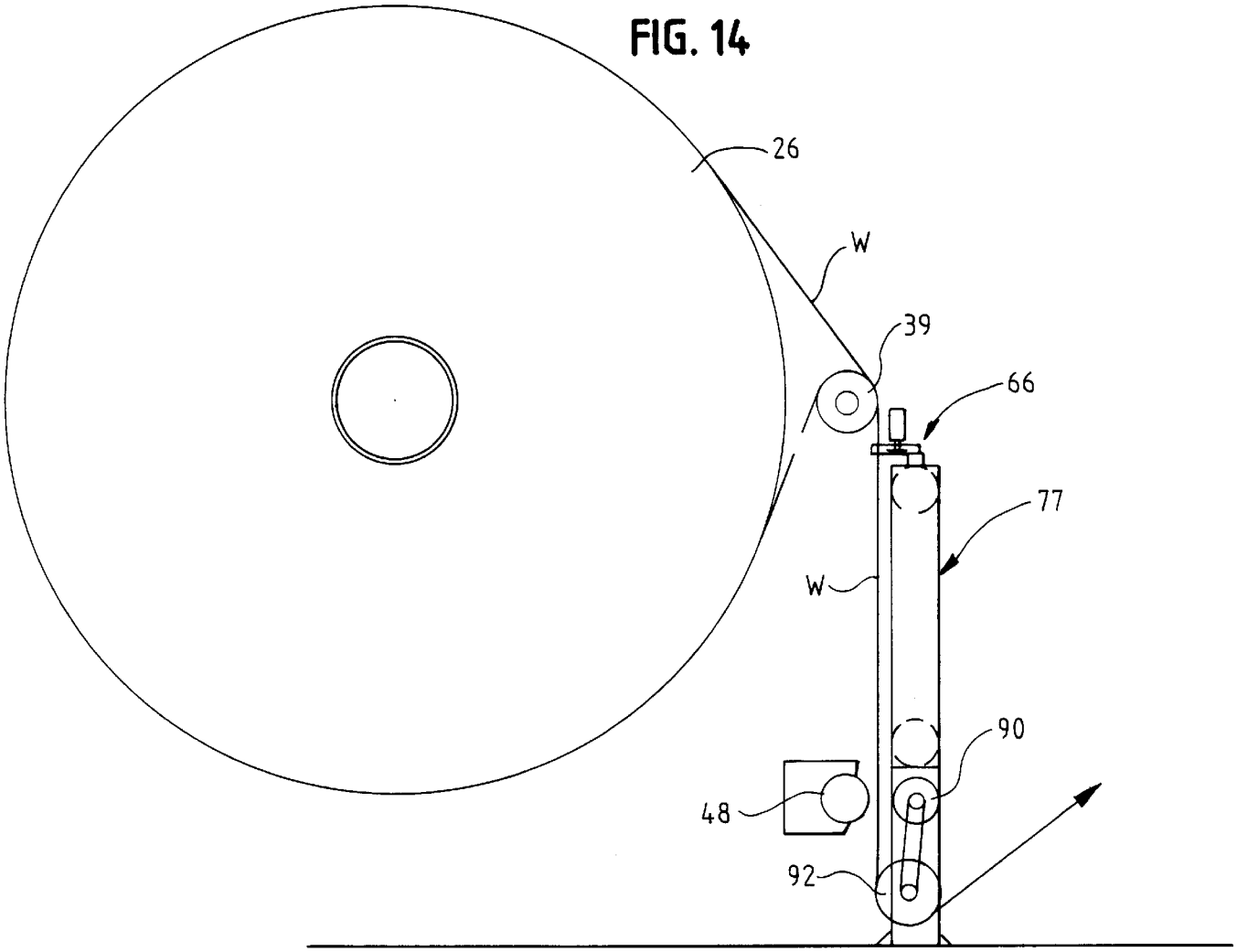
FIG. 14 illustrates the web from the new parent roll being unwound.

FIG. 13 shows the ply bonding wheel 90 pivoted counterclockwise so that it presses the trailing T and leading end L of the two webs against the vacuum/bonding roll 48. The drive belt 64 is engaged with the parent roll 26 to begin rotation of the parent roll, and the drive system for vacuum belts 79–81 of the vacuum belt assembly 77 begins to move the belts in a downstream direction so that both the trailing end T and the leading end L are advanced past the bonding wheel 90 and the vacuum/bonding roll 48 to bond the two web portions together. After the trailing end T passes the vacuum/bonding roll 48, vacuum to the roll 48 can be shut off. The rewinder line jogs the spliced connection through the downstream equipment, and the new parent roll 26 can then be brought up to normal unwinding speed as shown in FIG. 14.

The vacuum belts 79–81 provide a substantial length to hold the trailing end T of the old web and maximizes the length and therefore the strength of the ply-bonded splice. The belts also ensure a more even ply-bonded spliced section to eliminate clumping of the old web in the ply bonding area. The vacuum belts also eliminate tension in the web, thus reducing tears.

The preferred embodiment of the invention uses movable vacuum belts to hold the trailing end of the old web. However, it is possible to omit the belts and simply provide a plurality of vacuum ports in the wall of the casing 78 which faces the web. When a source of vacuum is connected the vacuum plenum, the web of the old roll is drawn against the casing of the plenum to retain the web while it is slit. The vacuum can be shut off after the ply bonding wheel begins to bond the trailing end of the old web and the lead end of the new web so that the trailing end can move through the ply bonding section.

The preferred embodiment of the invention also uses the vacuum bonding roll assembly 44 to provide the dual functions of providing a downstream vacuum retainer for the new web and bonding the two webs together. However, those two functions can also be provided by separate structure. For example, a conventional vacuum retaining device can be mounted on each of the roll support frames downstream from the ply bonding wheel 90, and a conventional ply bonding device can be mounted on each of the roll support frames upstream of the vacuum retaining device for cooperating with the ply bonding wheel. The vacuum retaining device can be provided by a casing which encloses a vacuum plenum and which is provided with a plurality of vacuum ports.

The foregoing unwinding and splicing apparatus can be used with either single ply webs or multiple ply webs, depending on the bonding characteristics of the web.

B. FIG. 15

Figure 15:
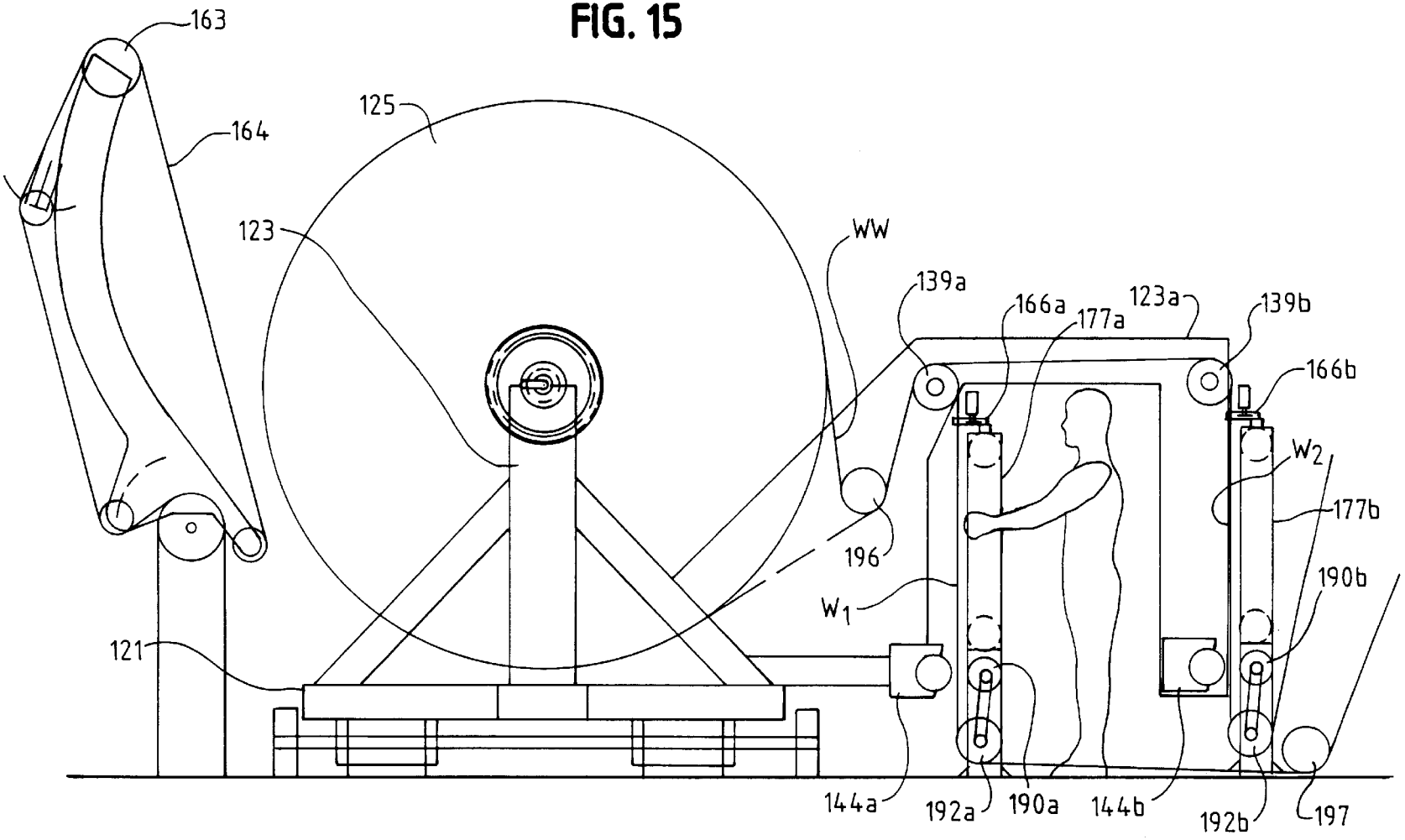
FIG. 15 is a view similar to FIG. 1 showing a splicing apparatus for parent rolls with two-ply webs.

In some applications it may be desirable to separate the plies of a multiple ply web and splice and bond the plies individually. FIG. 15 illustrates an unwinding and splicing apparatus 120 which is similar to the apparatus 20 except that it is designed to unwind and splice two-ply webs. The reference numerals for the apparatus 120 refer to like parts but will be increased by 100.

A carriage 121 includes a first roll support frame 123 and a second roll support frame (not shown) for a first parent roll 125 and a second parent roll (not shown). Each roll support frame includes a pair of idler rolls 139*a* and 139*b* and a pair of vacuum bonding roll assemblies 144*a* and 144*b*. The idler rolls 139*b* and the vacuum bonding roll assemblies 144*b* are supported by L-shaped frame extension 123*a*.

The unwinding and splicing apparatus includes a pair of slitter assemblies 166*a* and 166*b*, a pair of vacuum belt assemblies 177*a* and 177*b*, a pair of ply bonding wheels 190*a* and 190*b*, and a pair of idler rolls 192*a* and 192*b*.

A two-ply web WW travels over an idler roll 196, and the two ply web is separated into plies $W_1$ and $W_2$ at the idler roll 139*a*. The web $W_1$ travels over idler roll 192*a* and idler roll 197. The web $W_2$ travels over idler roll 139*b* and idler roll 192*b*. The two plies are joined downstream in the equipment which processes the webs.

When the parent roll is changed, the web plies $W_1$ and $W_2$ are held by the vacuum belt assemblies 177*a* and 177*b* and cut by the slitters 166*a* and 166*b* as previously described. The carriage 121 is then moved to replace the parent rolls, and each of the new webs $W_1$ and $W_2$ is bonded to the old webs as previously described.

The novelty of the two splice head design is that it allows the web to be separated, spliced, and rejoined. There are many installations where a multi-ply parent roll is made in an off line machine by unwinding two or more single ply parent rolls and rewinding them on the same spool. In the converting process, the two or more plies may require lamination. The lamination device requires the webs to be separated, adhesive applied between the plies, and the webs to be rejoined. All splicing devices with which we are familiar are not capable of separating and splicing the individual plies, so those devices are useless for a laminating line.

C. FIGS. 16–21

Figure 16:
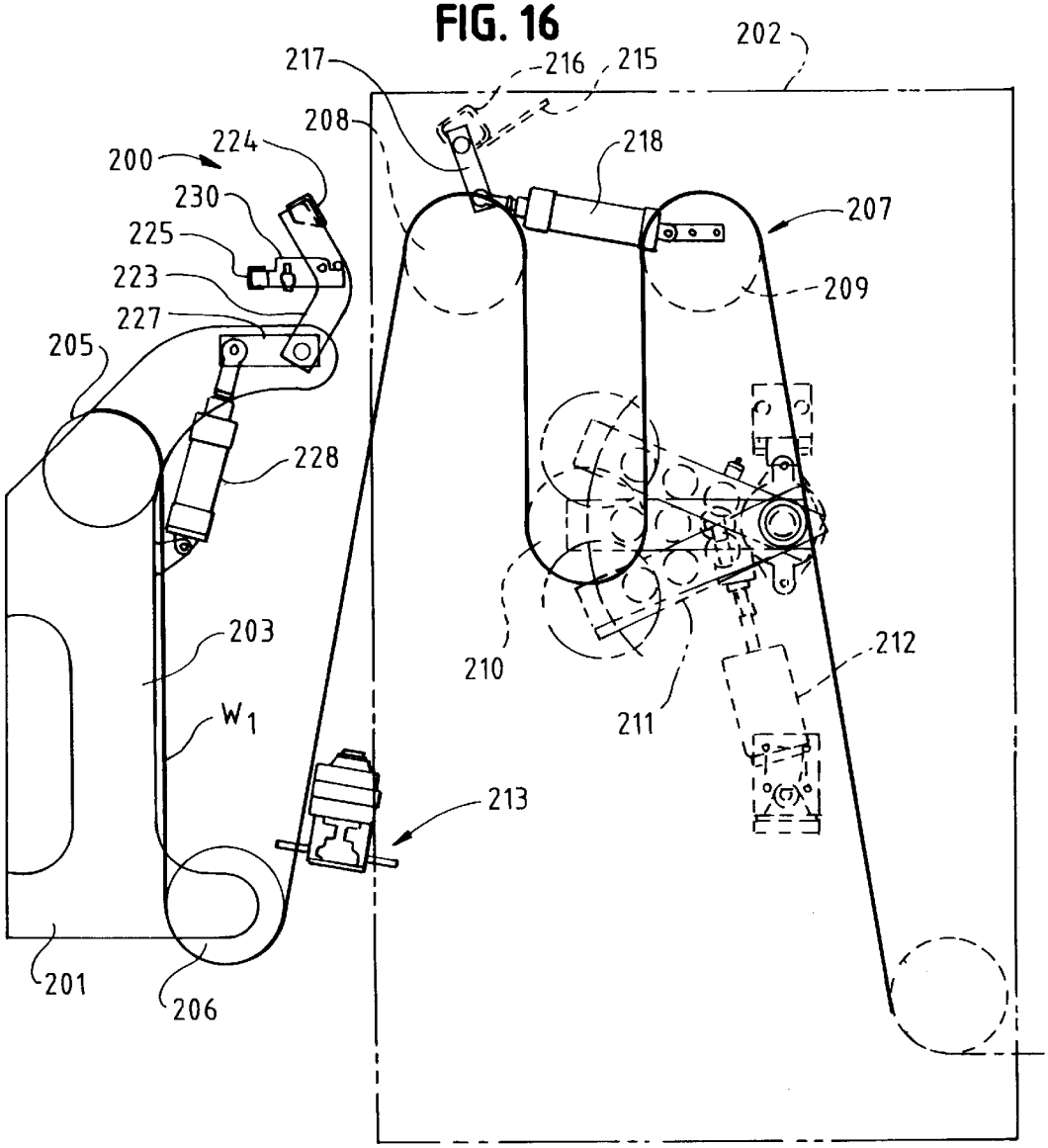
FIG. 16 illustrates another embodiment of a splicing apparatus.

FIG. 16 illustrates another embodiment of an unwinding and splicing apparatus 200 which includes a movable carriage 201 and a stationary frame 202. The movable carriage 201 is similar to the carriage 21 of FIG. 1 and includes two support frames 203 and 204 (FIGS. 16 and 18) for rotatably supporting first and second parent rolls. Upper and lower idler rolls 205 and 206 are rotatably supported on each roll support frame for guiding the web $W_1$ of the first parent roll.

The web travels from the idler roll 206 on movable carriage in an upwardly inclined direction to dancer roll assembly 207 on the stationary frame 202. The dancer roll assembly 207 includes idler rolls 208 and 209 which rotate about fixed axes and a pivoting roll 210 which is mounted on a pivot arm 211. The position of the pivoting arm 211 and the roll 210 is adjustable by a cylinder 212 to adjust the tension in the web.

A slitter assembly 213 which corresponds to the slitter assembly 66 of FIG. 1 is mounted on the frame 202 for cutting the web when the parent roll is to be changed.

Figure 17:
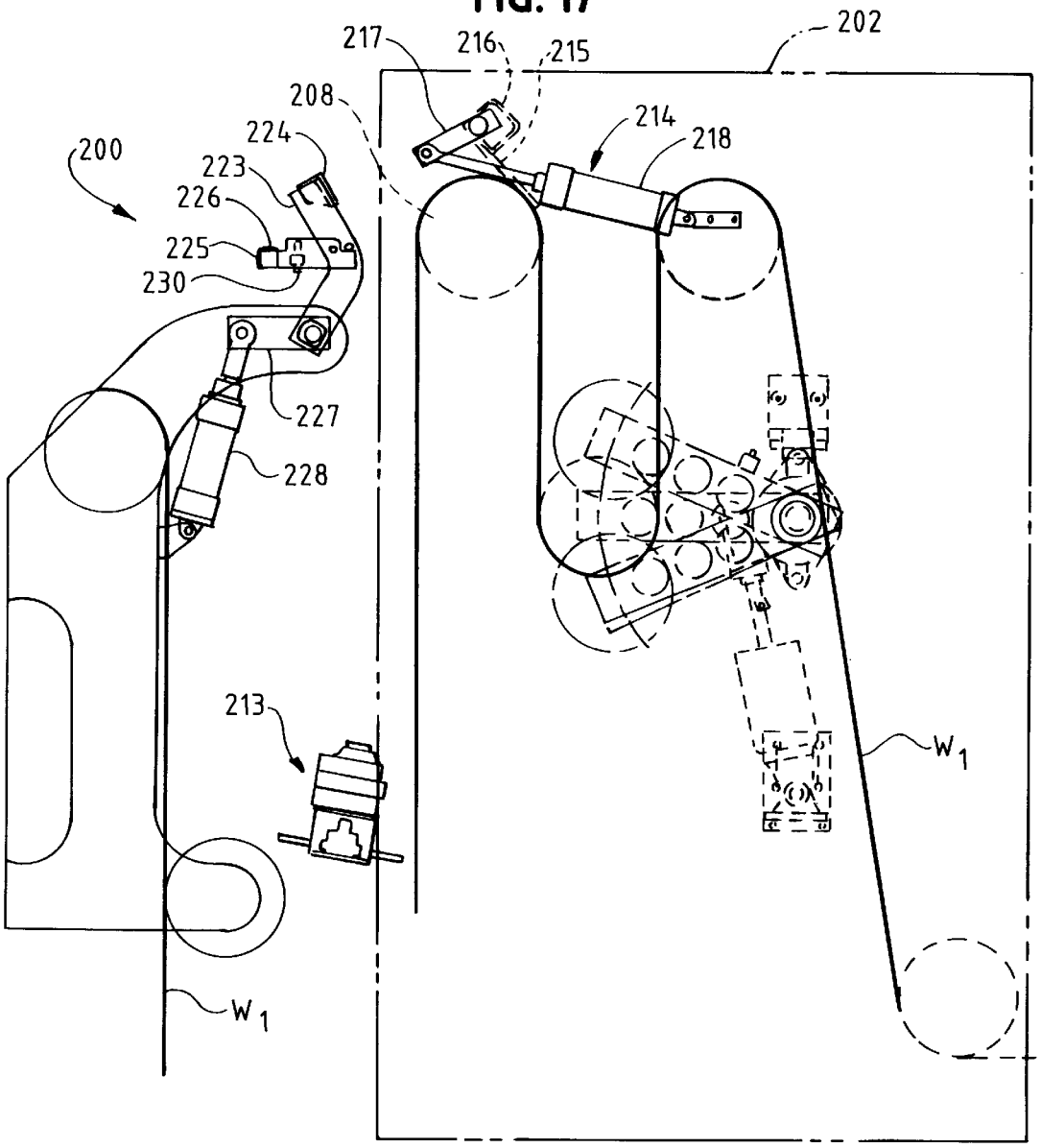
FIG. 17 illustrates the splicing apparatus of FIG. 16 after the web is cut.

FIG. 17 illustrates the unwinding and splicing apparatus 200 after the web has stopped and the slitter assembly 213 has traversed across the web to cut the web. The trailing end T of the web $W_1$ hangs down from the roll 208 of the dancer roll assembly.

The embodiment of FIGS. 16–21 also includes a web cutting assembly 214 which is used to hold the web on the idler roll 208. The web cutting device thereby prevents upstream tension in the web from pulling the severed web over the idler roll 208, which would result in a missed splice.

The web cutting assembly 214 includes a strip of belting material 215 which is attached to a bar 216 which is rotatably mounted on the frame 202. The bar 216 and the strip 215 are pivoted by a crank arm 217 which is attached to the bar and a cylinder 218 which is mounted on the frame. The web cutting device is used to press the web against the idler roll 208 while the web is in motion in order to brake the web and cause the web to sever.

Figure 18:
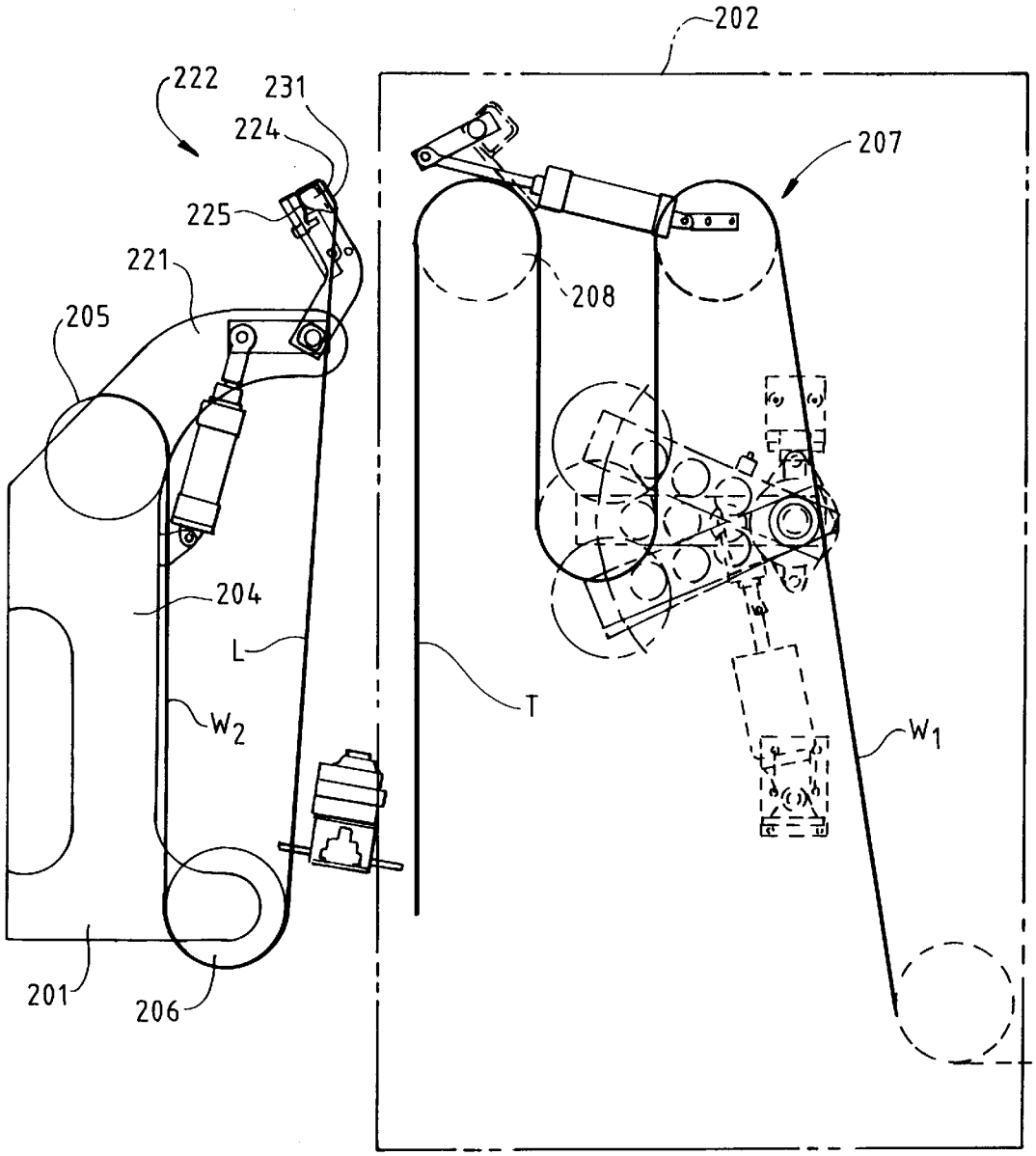
FIG. 18 illustrates the web of a new parent roll moved into alignment with the trailing end of the web from the first parent roll.

FIG. 18 illustrates the carriage 201 moved to bring the roll support frame 204 and the leading end L of a new web $W_2$ into alignment with the trailing end T of the old web $W_1$. Each of the roll support frames on the carriage includes a pair of arms 221 and a web holding assembly 222 which is pivotally mounted on the ends of the arms 221. As can be seen best in FIGS. 16 and 21, the web holding assembly 222 includes a pair of generally L-shaped arms 223 which are pivotally mounted on the arms 221 and a channel 224 which extends transversely across the web between the two L-shaped arms 223. A clamp arm 225 is pivotally mounted on each of the L-shaped arms 223, and a bar 226 extends transversely across the web between the two clamp arms. The L-shaped arms 223 are pivoted by a crank arm 227 and a cylinder 228.

Referring again to FIG. 18, the leading end L of the web extends over the channel 224 and is held on the channel by the bar 226 which presses the web against the left side of the channel. The bar 226 is advantageously formed of magnetic material so that it is magnetically attached to the channel 224.

Figure 19:
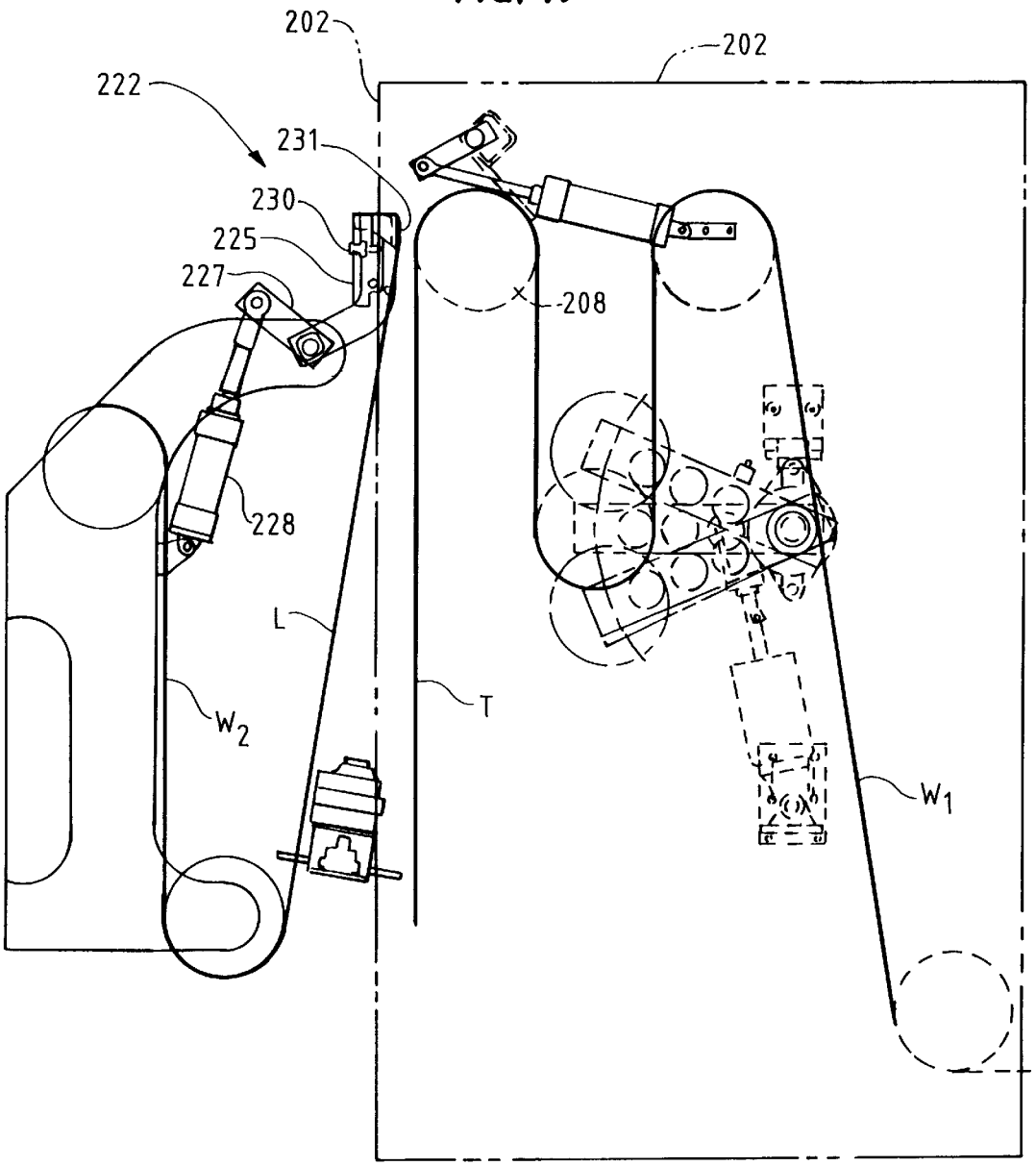
FIG. 19 illustrates the holding device for the new web being moved toward the old web.
Figure 20:
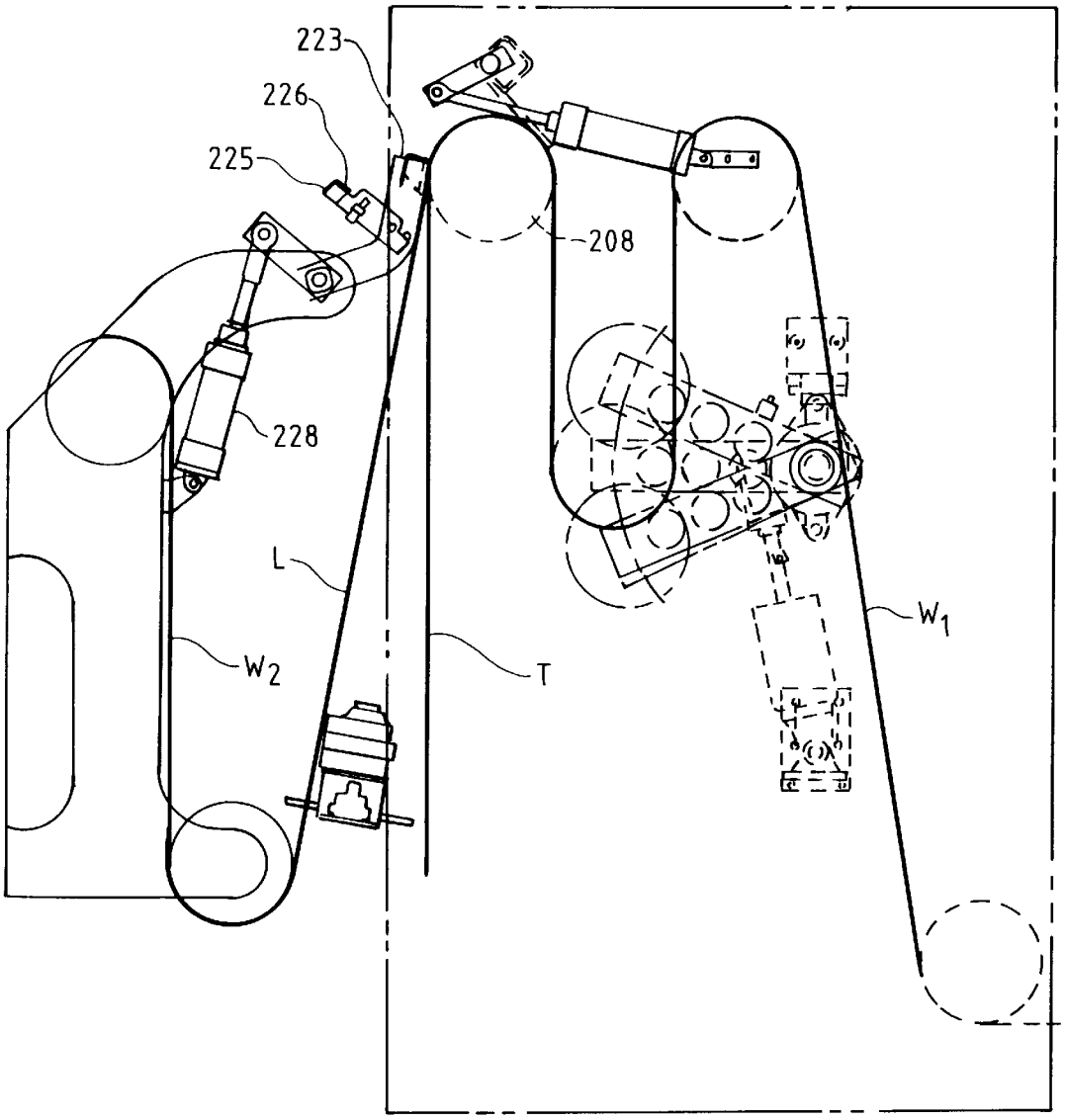
FIG. 20 illustrates the new web being pressed against the old web and the holding device for the new web in an open position.

After the leading end L of the new $W_2$ is aligned with the trailing end T of the old web $W_1$, the cylinder 228 is actuated to pivot the web holding assembly 222 toward the idler roller 208 on the frame 202 as illustrated in FIG. 19. As the web holding assembly 222 passes the front edge 202*a* of the frame, a bolt 230 on one of the clamping arms 225 engages the front edge 202*a* and causes the clamping arm 225 to pivot counterclockwise as the L-shaped arm 223 continues to pivot toward the idler roller 208 as illustrated in FIG. 20.

Before the cylinder 228 is actuated, double-sided adhesive tape 231 (FIG. 18) or other means for adhesively attaching the two webs is applied to the portion of the leading end L of the new web which overlies the right side of the channel 224. As the L-shaped arms 223 and the channel 224 press the leading end L of the new web against the trailing end T of the old web as illustrated in FIG. 20, the two webs become adhesively attached. The idler roll 208 provides a backstop against which the channel 224 presses the webs and the tape.

Figure 21:
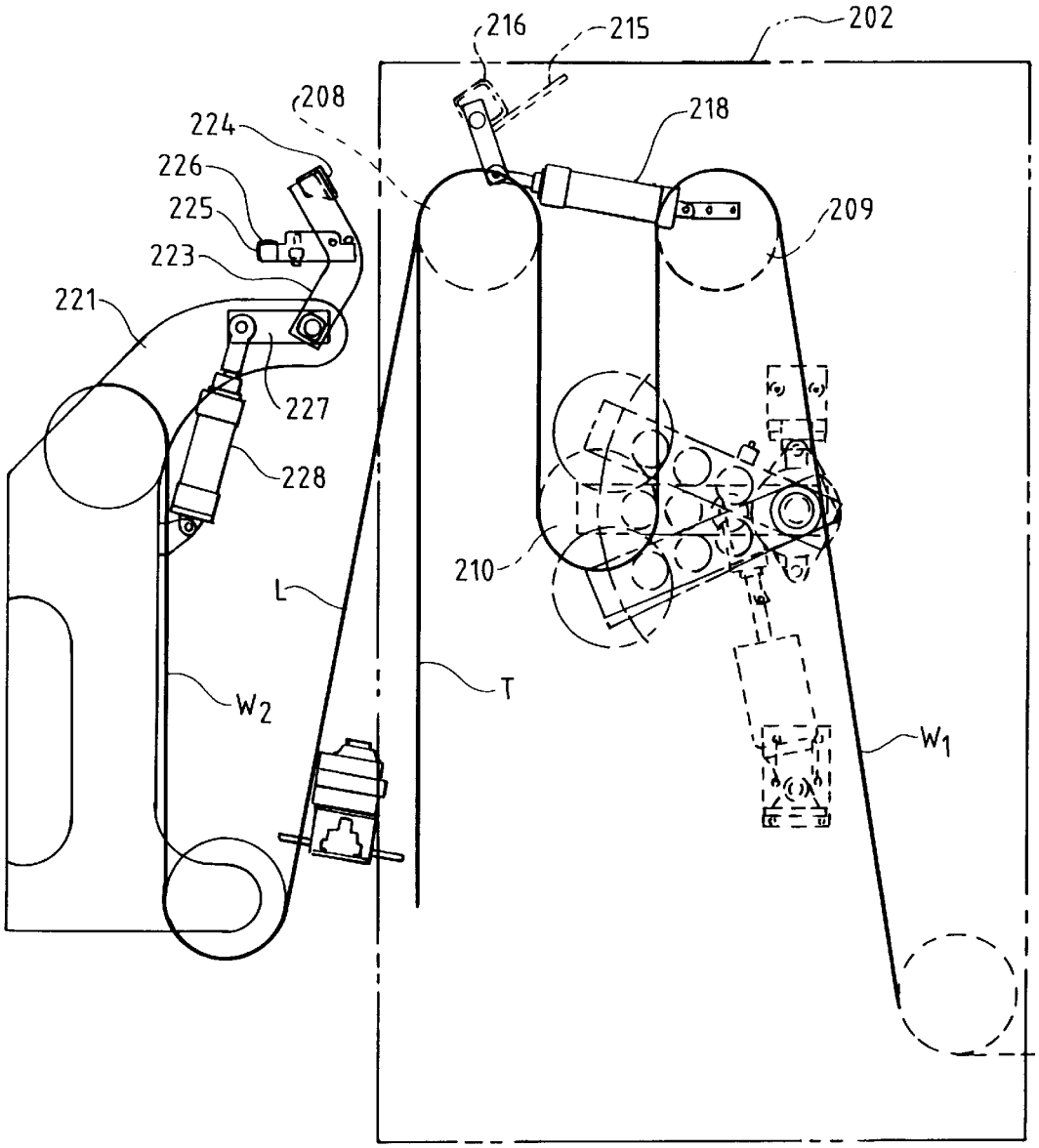
FIG. 21 illustrates the holding device for the new web returned to its original position and the new web being joined to the old web.

The cylinder 228 can then be actuated to pivot the L-shaped arms 223 and the channel 224 counterclockwise as illustrated in FIG. 21, and the leading end L of the new web will remain adhesively secured to the railing end T of the old web. The cylinder 218 is also actuated to move the braking strip 215 away from the idler roll 208. The drive for the unwinding apparatus and the downstream drive for the web can then be activated to move the spliced portion of the web through the machine.

Instead of using adhesive tape to secure the two webs together, the webs could be bonded together with a ply bonding device similar to that which was described with respect to the embodiment of FIGS. 1–14.

In contrast to the embodiment of FIG. 1, in FIGS. 16–21, the web is guided upwardly and to the right in the area where the web is cut by the slitter assembly 213. The trailing end T of the old web $W_1$ hangs vertically downwardly from the idler roll 208 away from the leading end L of the new web $W_2$.

D. FIGS. 22–27

FIGS. 22–27 illustrate a unwinding and splicing apparatus 300 which is similar to the unwinding splicing apparatus 200, but which includes a vacuum belt assembly 335 which is mounted in a stationary position on frame 302. The other parts of the apparatus 300 correspond to the parts of apparatus 200 and are identified by like reference numerals increased by 100. The vacuum belt assembly 335 is similar to the vacuum belt assembly 77 of FIG. 1 and includes a plurality of vacuum belts 336 which are entrained over upper and lower rollers 337 and 338.

Figure 22:
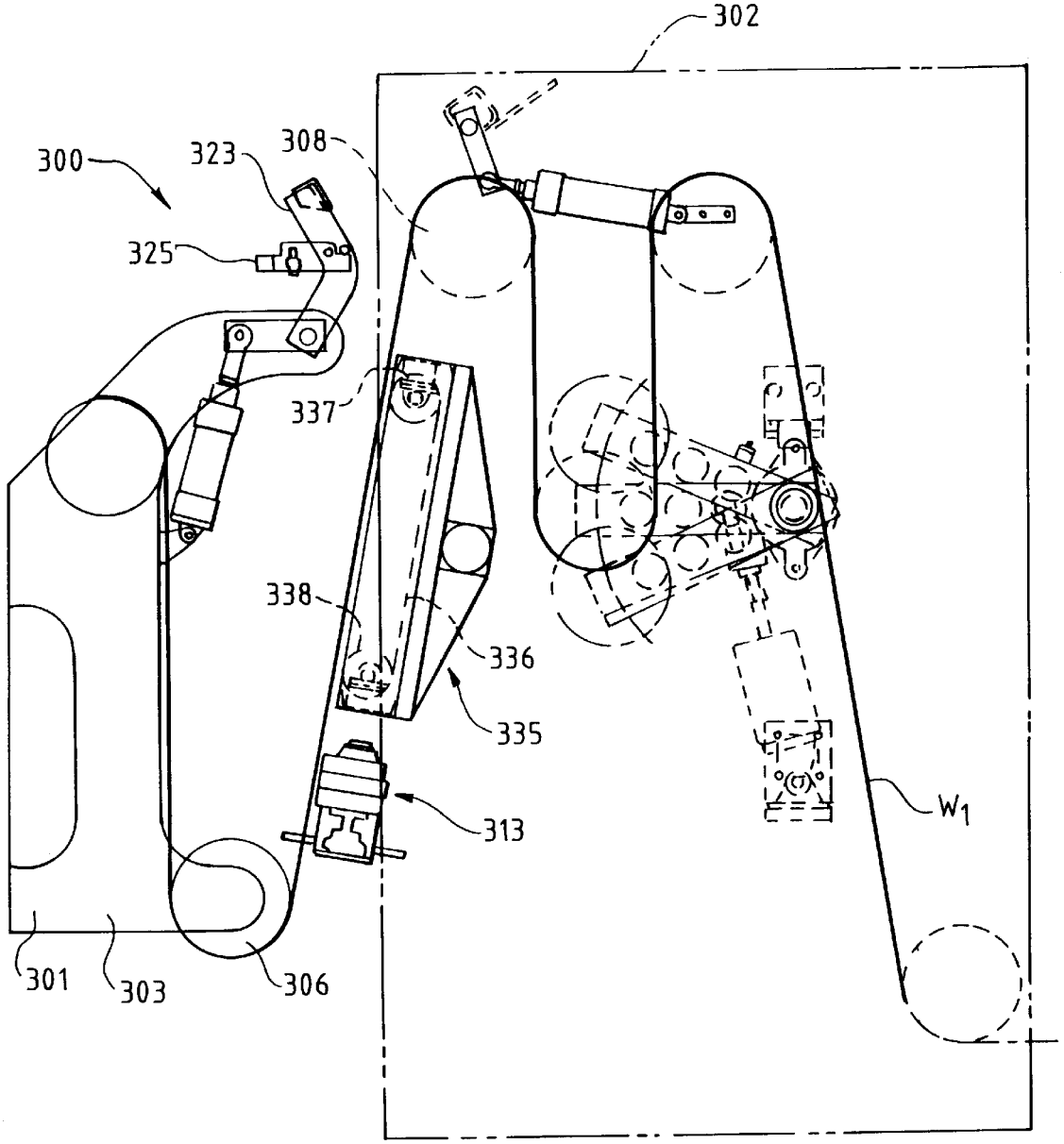
FIG. 22 illustrates a splicing apparatus similar to the splicing apparatus of FIG. 16 but including a vacuum box for holding the old web.

FIG. 22 corresponds to FIG. 16 and illustrates the normal operating position of the unwinding and splicing apparatus 300.

Figure 23:
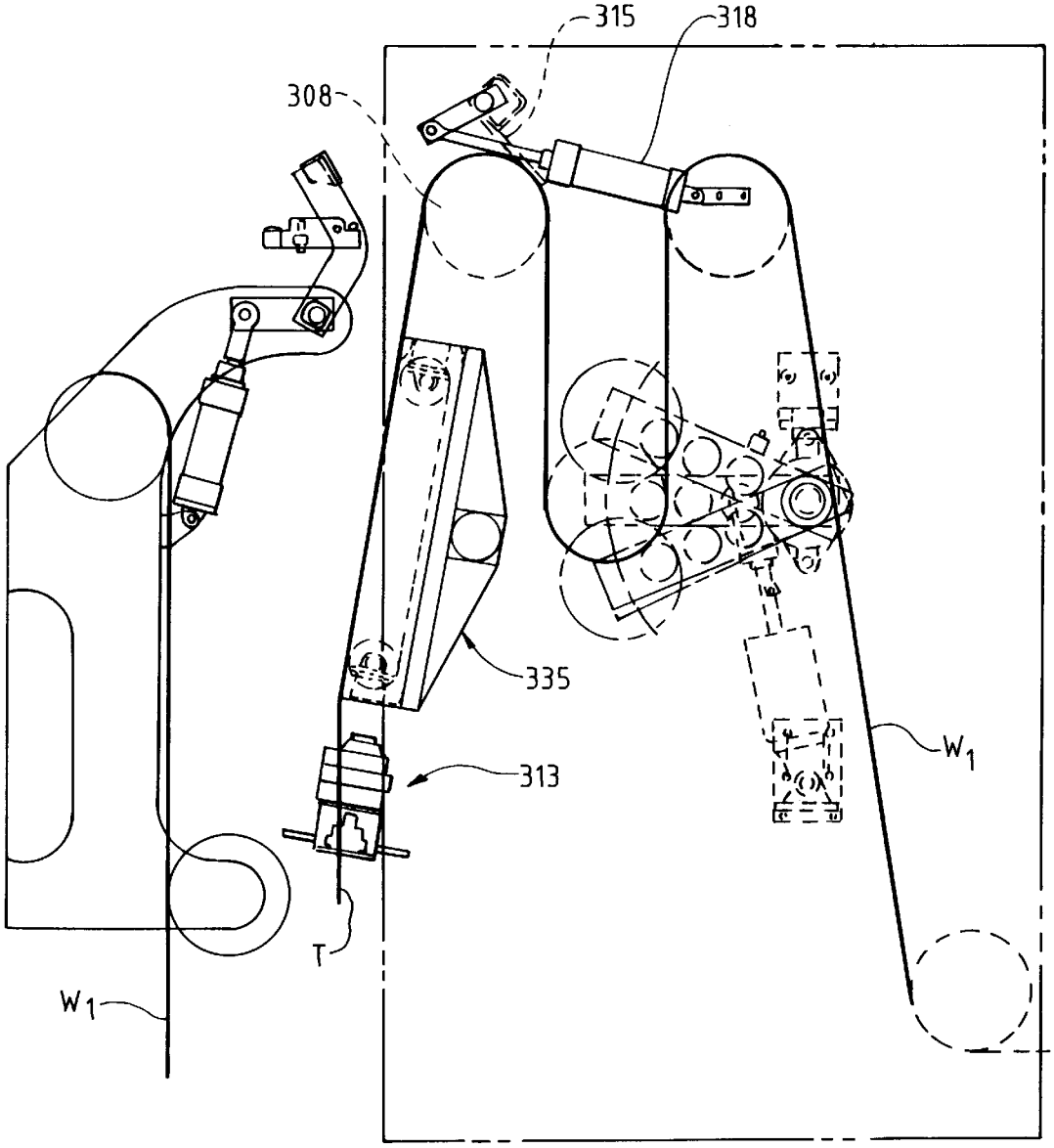
FIG. 23 illustrates the splicing apparatus of FIG. 22 after the web is cut.

In FIG. 23 the machine has stopped, vacuum is supplied to the vacuum belt assembly 335 to draw the web $W_1$ against the vacuum belts, and the slitter 313 traverses across the web to slit the web and form a trailing end T. The cylinder 318 can be actuated to cause the brake strip 315 to press the web against the idler roller 308.

Figure 24:
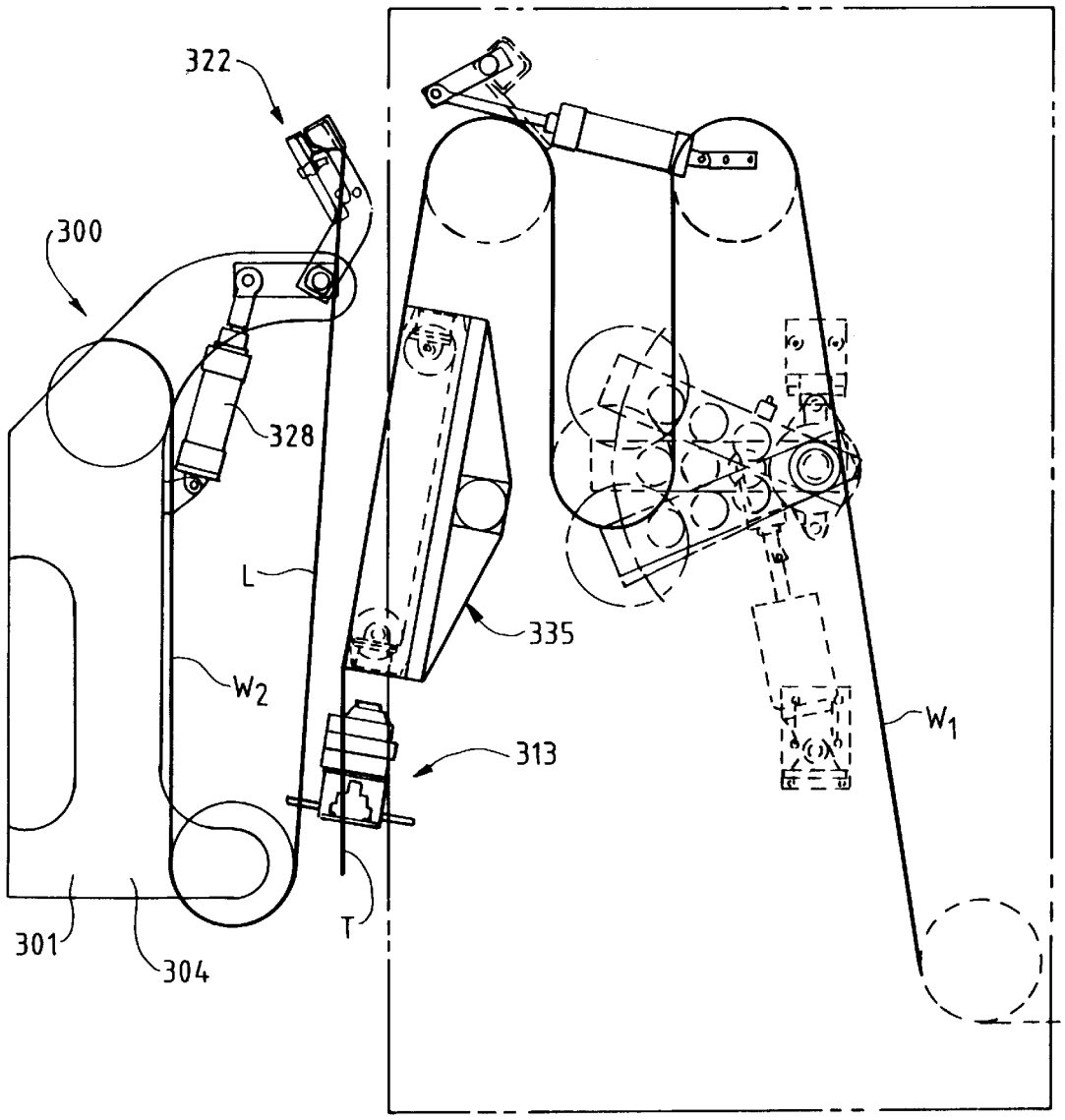
FIG. 24 illustrates the web of a new parent roll moved into alignment with the trailing end of the web from the first parent roll.

FIG. 24 corresponds to FIG. 18 and illustrates the carriage 201 in its alternate position so that the leading end L of a new parent roll is aligned with the trailing end T of the old parent roll. The leading end of the new web $W_2$ is held by a web holding assembly 322.

Figure 25:
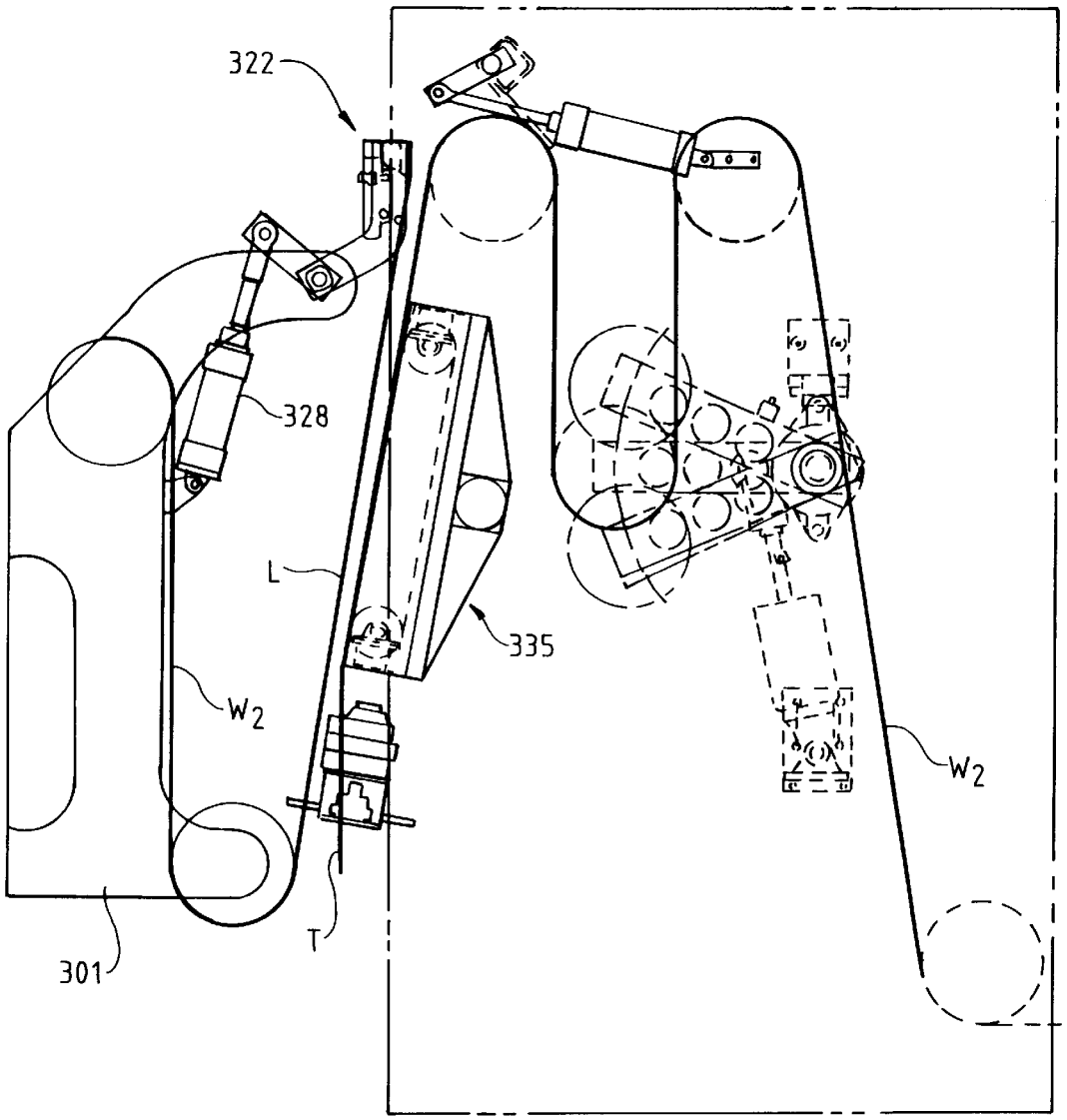
FIG. 25 illustrates the holding device for the new web moving the new web toward the old web.
Figure 26:
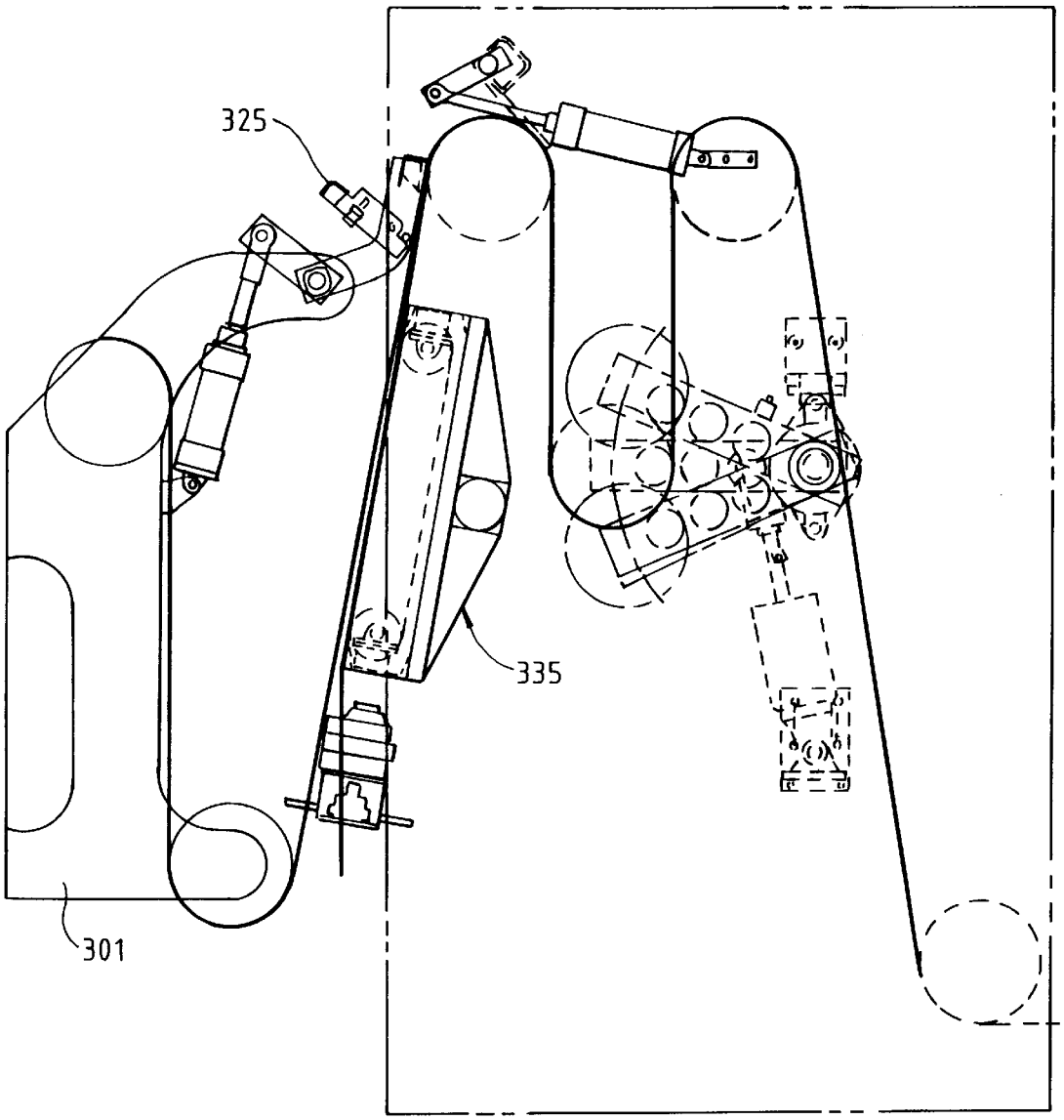
FIG. 26 illustrates the new web being pressed against the old web and the holding device for the new web in an opened position.

FIGS. 25 and 26 correspond to FIGS. 19 and 20 and show the web-holding assembly 322 pivoted to adhesively attach the leading end L of the new web to the trailing end T of the old web.

Figure 27:
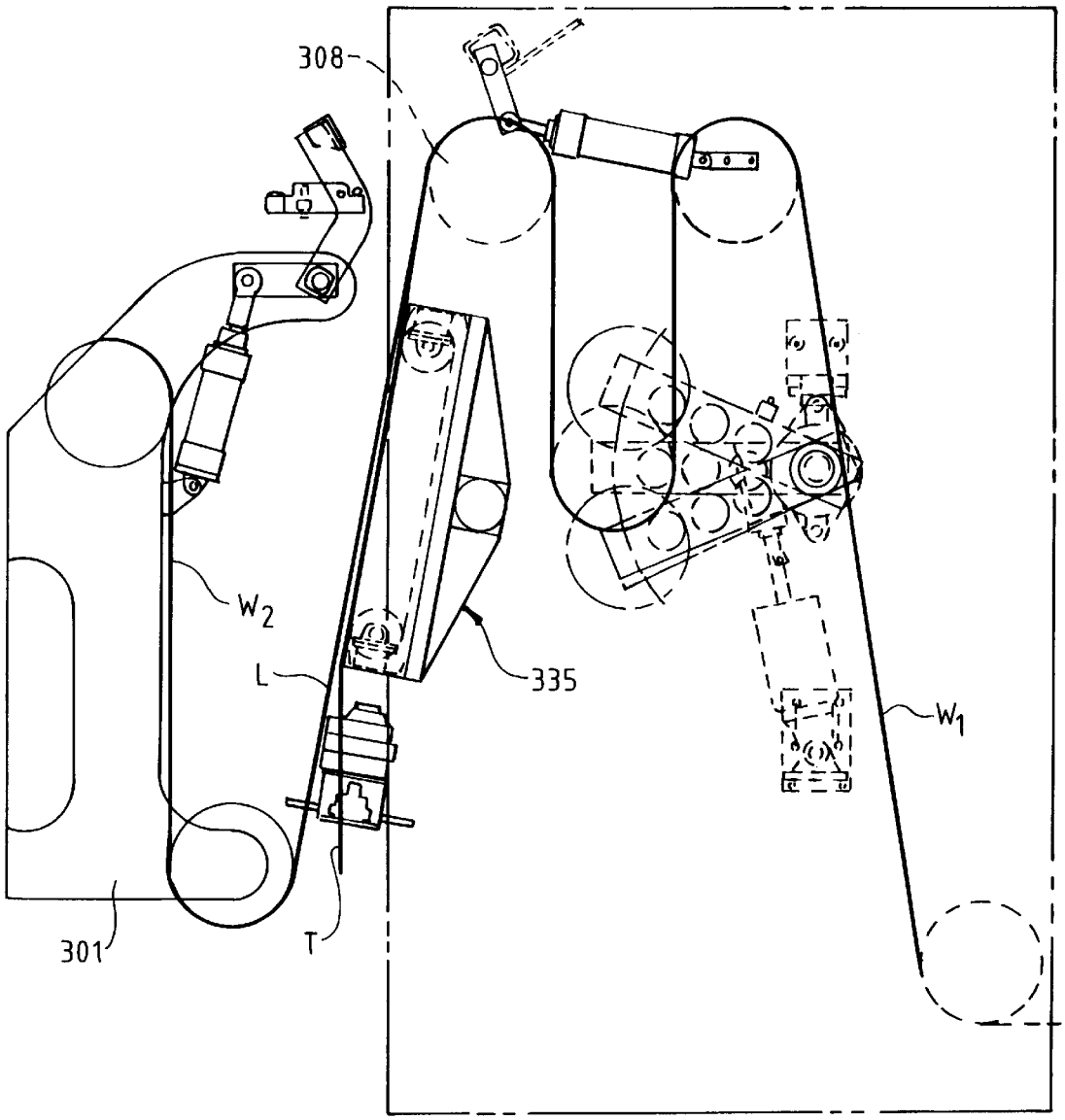
FIG. 27 illustrates the holding device returned to its original position.

FIG. 27 corresponds to FIG. 21 and shows the machine ready to be restarted. The vacuum belts 336 can be driven to assist in advancing the trailing end T, or the vacuum can be shut off.

As described previously with respect to the FIG. 1 embodiment, it is possible to omit the movable vacuum belts from the vacuum assembly 335 and simply provide a plurality of vacuum ports in the wall of the casing which provides the vacuum plenum.

Although we have referred to some of the rolls in the various embodiments as idler rolls, with current technology any of the rolls which are described as idler rolls could also be driven.

While in the foregoing specification a detailed description of specific embodiments of the invention was set forth for the purpose of illustration, it will be understood that many of the details herein given can be varied considerably by those skilled in the art without departing from the spirit and scope of the invention.

We claim:

1. A splicing apparatus for an unwinder which is adapted to unwind a roll of web material and advance the web along a path of web movement from an upstream direction to a downstream direction comprising:

a first roll support frame for supporting a first roll of web material, a second roll support frame for supporting a second roll of web material, each of the roll support frames being movable from an unwinding position in which a roll on the roll support frame is aligned with said path of web movement and a loading position in which a roll on the support frame is laterally offset from said path, a stationary frame, web supporting means on the stationary frame for supporting a web as the web is advanced along said path, a slitter mounted on the stationary frame upstream of said web supporting means, a web holder movably mounted on each of the roll support frames for movement toward and away from the web supporting means on the stationary frame, each of the web holders being movable to a splicing position in which a web held by the web holder is pressed against a web supported by the web supporting means on the stationary frame.

2. The apparatus of claim 1 in which the web supporting means includes a roller rotatably mounted on the stationary frame, each of the web holders being pressed against said roller when the web holder is in the splicing position.

3. The apparatus of claim 1 including a vacuum retainer mounted on the stationary frame between the slitter and the web support means on the stationary frame.

4. The apparatus of claim 3 in which the vacuum retainer includes a vacuum belt movably mounted for movement in the direction of web movement.

5. The apparatus of claim 1 in which each of the web holders includes a first arm pivotably mounted on a respective one of the roll support frames, a clamping arm pivotally attached to the first arm, and clamping means on the first arm and the clamping arm for clamping a web therebetween.

6. The apparatus of claim 5 in which said clamping means includes a bar attached to the first arm and extending transversely across the web and a bar attached to the clamping arm and extending transversely across the web.

7. The apparatus of claim 1 including web supporting means on each of the roll support frames for supporting a web as the web is advanced, the path of web movement between the web supporting means on each of the roll support frames and the web supporting means on the stationary frame being angled upwardly from the roll support frame to the stationary frame.

* * * * *